United States Patent [19]

Wakatake

[11] Patent Number: 4,521,983

[45] Date of Patent: Jun. 11, 1985

[54] ROTATING DISPLAY ELEMENT AND DISPLAY UNIT USING THE SAME

[76] Inventor: Yoshimasa Wakatake, No. 405, 9-5 Tamagawa 1-chome, Setagaya-ku, Tokyo 158, Japan

[21] Appl. No.: 619,160

[22] PCT Filed: Oct. 7, 1983

[86] PCT No.: PCT/JP83/00332

§ 371 Date: Jun. 7, 1984

§ 102(e) Date: Jun. 7, 1984

[87] PCT Pub. No.: WO84/01653

PCT Pub. Date: Apr. 26, 1984

[51] Int. Cl.[3] ..... G09F 11/02

[52] U.S. Cl. ..... 40/473; 40/449; 40/466

[58] Field of Search ..... 40/447, 451, 466, 773

[56] References Cited

U.S. PATENT DOCUMENTS

| | | | |
|---|---|---|---|
| 2,798,948 | 7/1957 | Le Vine et al. | 40/466 |
| 2,878,603 | 3/1959 | Heinz | 40/466 |
| 3,036,303 | 5/1962 | Knight | 40/449 |
| 3,140,553 | 7/1964 | Taylor | 40/449 |
| 3,231,995 | 2/1966 | Anthony | 40/473 |
| 3,295,238 | 1/1967 | Winrow | 40/449 |
| 3,365,824 | 1/1968 | Winrow | 40/449 |
| 4,110,925 | 9/1978 | Strand | 40/466 |
| 4,161,832 | 7/1979 | Bergamini | 40/466 |

*Primary Examiner*—Gene Mancene
*Assistant Examiner*—Wenceslao J. Contreras
*Attorney, Agent, or Firm*—Murray, Whisenhunt & Ferguson

[57] ABSTRACT

A rotating display element which is provided with a display surface member having a plurality of display surfaces which are selected by rotating the display surface member, and a display unit which uses the display element. The display surface member of the rotating display element has incorporated therein a permanent magnet type motor mechanism and is driven by the permanent magnet type motor mechanism. The rotor of the permanent magnet type motor mechanism has first and second double-pole permanent magnet members, and its stator has first and second magnetic members having wound thereon first and second exciting windings, respectively. The display unit has first and second power supply means for supplying power to the first exciting winding of the permanent magnet type motor mechanism and third and fourth power supply means for supplying power to the second exciting winding. The plurality of display surfaces of the display surface member can selectively be directed to the front by supplying power to the first exciting winding via the first or second power supply means and by supplying power to the second exciting winding via the third or fourth power supply means. A display panel can be constituted by arranging, in a matrix form, a number of such display units each employing the rotating display element.

4 Claims, 17 Drawing Figures

ROTATING DISPLAY ELEMENT AND DISPLAY UNIT USING THE SAME

TECHNICAL FIELD

The present invention relates to a rotating display element which is provided with a display surface member having a plurality of display surfaces and is arranged to select one of the display surfaces by rotating the display surface member and, further, the invention pertains to a display unit using such a rotating display elements.

BACKGROUND ART

Heretofore, various rotating display elements have been proposed, which are, however, defective in that the rotating mechanism for driving the display surface member must be provided separately of the rotating display element, or in that a selected one of the display surfaces of the display surface member does not assume a correct position.

Furthermore, a variety of display units using the rotating display element have also been proposed in the past but, in addition to the abovesaid defects of the rotating display element, the conventional display units possess the drawback of involving the use of complex means for selecting the plurality of display surfaces of the display surface member of the rotating display element.

DISCLOSURE OF THE INVENTION

The present invention is to provide a novel rotating display element free from the abovesaid defects and a display unit using such display element.

According to the display element of the present invention, only by supplying a power source to a first exciting winding of a stator of a motor mechanism through first or second power supply means and by supplying a power source to a second exciting winding of the stator of the motor mechanism through a third or fourth power supply means, a selected one of the plurality of display surfaces of the display surface member can be caused to face forwardly. Therefore, it is possible, with a simple arrangement, to selectively direct the plurality of display surfaces of the display surface member to the front.

Further, according to the display element of the present invention, even if the power supply to the abovesaid first and second exciting windings are cut off after the plurality of display surfaces of the display surface member are selectively directed to the front, since first and second double-pole permanent magnet members of a rotor forming the abovesaid motor mechanism act on first and second magnetic members of the stator forming the motor mechanism, the display surface member can be held with a selected one of the plurality of display surfaces thereof facing to the front. Consequently, no unnecesary power consumption is incurred.

Moreover, according to the display element of the present invention, the above-mentioned motor mechanism is incorporated in the display surface member. Accordingly, there is no need of preparing a display surface member driving mechanism separately of the display element.

In addition, according to the display unit of the present invention, the abovesaid display element of the present invention is employed, and the device for driving the display element is required only to have first and second power supply means for supplying power to the first and second exciting windings of the display element and third and fourth power supply means for supplying power to the second exciting winding. Accordingly, the display element can be driven with a simple arrangement.

BEST MODE FOR CARRYING OUT THE INVENTION

Figure 1:
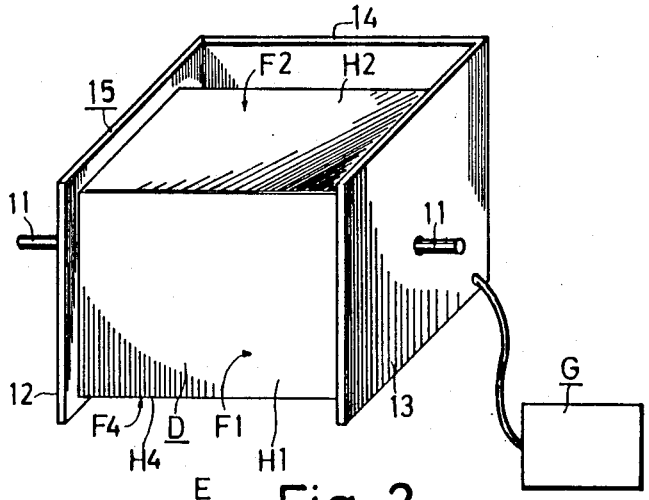
FIG. 1 is a schematic diagram illustrating, in principle, an embodiment of the display unit employing rotating display elements according to the present invention.

FIG. 1 illustrates, in principle, an embodiment of the display unit employing a rotating display element of the present invention. The display unit is provided with a rotating display element (hereinafter referred to simply as display element for the sake of brevity) E and a driving device G for driving the display element E.

The display element E has a display surface member D and a permanent magnet type motor mechanism (hereinafter referred to simply as motor mechanism for the sake of brevity) identified by Q in FIGS. 2 to 4.

Figure 2:
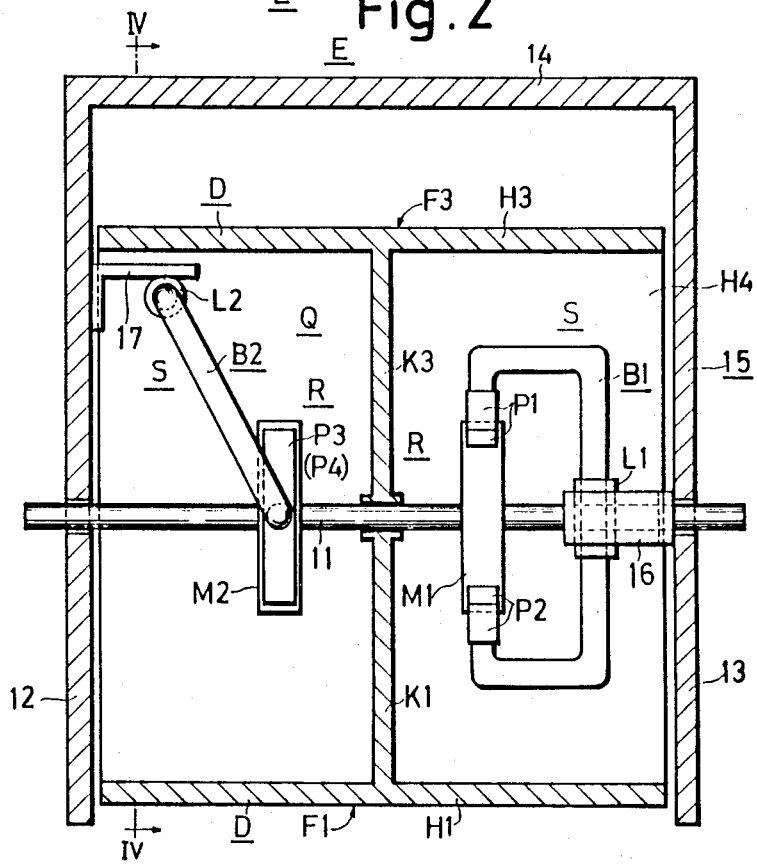
FIG. 2 is a plan view, partly in section, showing an example of the rotating display elements used in the display unit depicted in FIG. 1.
Figure 3:
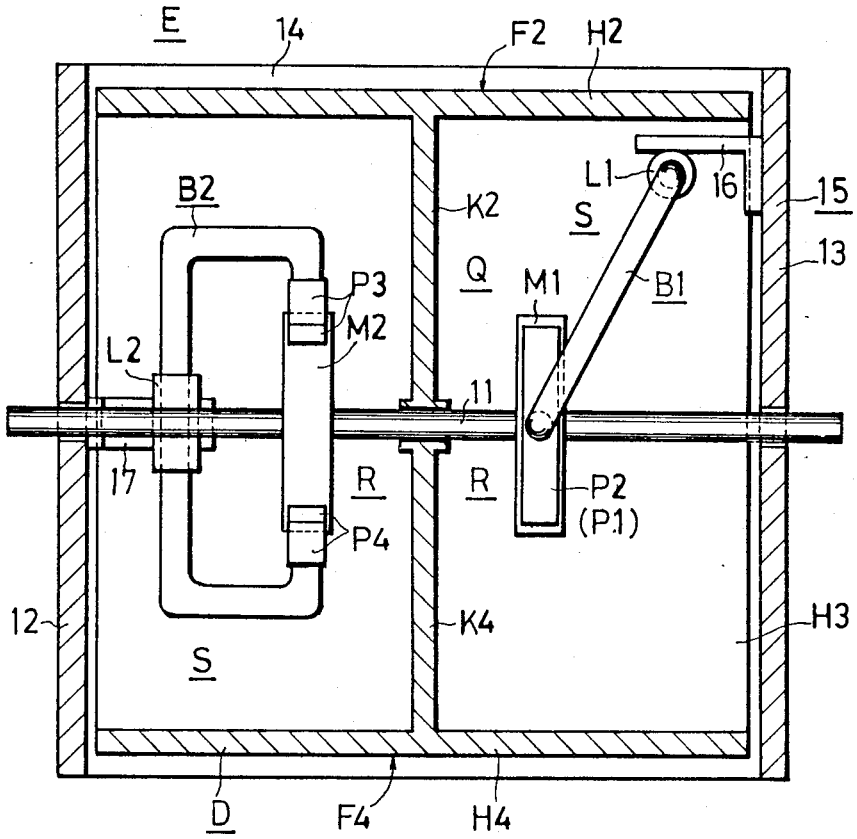
FIG. 3 is a front view, partly in section, similar to FIG. 2.
Figure 4:
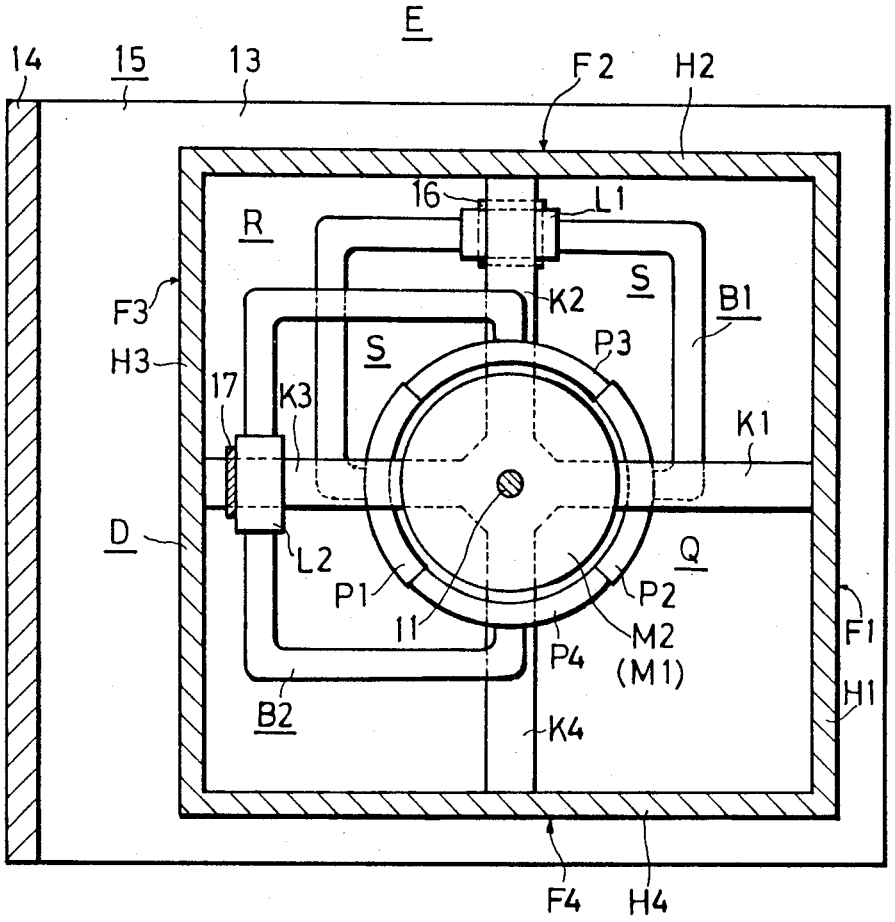
FIG. 4 is a side view, partly in section, as viewed from the line IV—IV in FIG. 2.

As will be seen from FIGS. 2 to 4, an example of the display surface member D is a tubular body and has four display panels H1, H2, H3 and H4 disposed around its axis at equiangular intervals of 90°. On the outer surfaces of the four display panels H1, H2, H3 and H4 are formed display surfaces F1, F2, F3 and F4, respectively.

An example of the motor mechanism Q has a rotary shaft 11, and the rotary shaft 11 has mounted thereon two double-pole permanent magnet members M1 and M2 which are disposed side by side in the lengthwise direction of the rotaty shaft 11 and each of which has north and south magnetic poles.

The one double-pole permanent magnet member M1 is, for example, a disc-shaped one and, on its outer peripheral surface, the north and south magnetic poles are spaced apart an angular distance of 180° around the rotary shaft 11.

The other double-pole permanent magnet member M2 is also a disc-shaped one and, its both free end faces, the north and south magnetic poles are spaced apart an angular distance of 180° around the rotary shaft 11. The north and south poles of the double-pole permanent magnet member M1 are disposed around the rotary shaft 11 at an angular distance $\pm\alpha°$ (where $\alpha°$ has a value represented by $0° \leqq \alpha° < 180°$ and including 0° apart from the south magnetic poles of the double-pole permanent magnet members M2. In the drawings, there is shown the case where $\alpha° = 0°$, for the sake of simplicity.

The rotary shaft 11 and the double-pole permanent magnet members M1 and M2, mentioned above, constitute a rotor R of the motor mechanism Q.

The rotor R of the motor mechanism Q is rotatably supported by a support 15 which is composed of left, right and rear panels 12, 13 and 14. That is, the rotary shaft 11 forming the rotor R is pivotally mounted between the left and the right panels 12 and 13 of the support 15.

An example of the motor mechanism Q comprises a magnetic member B1 which has magnetic poles P1 and P2 acting on the north and south magnetic poles of the abovesaid double-pole permanent magnet member M1, a magnetic member B2 which similarly has magnetic poles P3 and P4 acting on the north and south magnetic poles of the double-pole permanent magnet member M2, an exciting winding L1 wound on the magnetic member B1 in a manner to excite the magnetic poles P1 and P2 in reverse polarities, and an exciting winding L2 wound on the magnetic member B2 in a manner to excite the magnetic poles P3 and P4 in reverse polarities.

The magnetic poles P1 and P2 of the magnetic member B1 are spaced apart an angular distance of 180° around the axis of the rotor R, i. e. the rotary shaft 11.

The magnetic poles P3 and P4 of the magnetic member B2 are also spaced apart an angular distance of 180° around the rotary shaft 11 of the rotor R. But the magnetic poles P3 and P4 of the magnetic member B2 are spaced an angular distance $\pm 90° \pm \alpha°$ apart from the magnetic poles P1 and P2 of the magnetic member B1. In the drawings, however, there is shown the case where $\alpha° = 0°$ as mentioned previously and $+90°$ is selected from $\pm 90°$ and, accordingly, the former magnetic poles are spaced $+90°$ apart from latter magnetic poles.

The magnetic poles P1 and P2 of the magnetic member B1 and the magnetic poles P3 and P4 of the magnetic member B2 respectively extend over an angular range of about 90° around the roraty shaft 11 of the rotor R.

The magnetic members B1 and B2 and the exciting windings L1 and L2 form a stator S of the motor mechanism Q.

The stator S of the motor mechanism Q is fixedly supported by the aforementioned support 15. That is, the magnetic member B1 and the exciting winding L1 wound thereon are fixed to the support 15 through a support rod 16 which extends between the position of the exciting winding L1 and the inner side wall of the right panel 13 of the support 15. Likewise the magnetic member B2 and the exciting winding L2 wound thereon are fixed to the support 15 through a support rod 17 which extends between the position of the exciting winding L2 and the inner side wall of the left panel 12 of the support 15.

The display surface member D is mounted on the rotor R of the motor mechanism Q in such a manner that it houses therein the motor mechanism Q. That is, four support rods K1, K2, K3 and K4, extending in the radial direction of the rotary shaft 11 at 90° intervals, are fixed at one end to the rotary shaft 11 between the double-pole permanent magnet members M1 and M2 mounted on the rorary shaft, the free ends of the support rods K1, K2, K3 and K4 being secured to the display panels H1, H2, H3 and H4 of the display surface member D on the inside thereof, respectively.

In this case, the display surface member D is mounted on the rotor R in such a manner that, as shown in FIGS. 5, 9, 12 and 15, the display surface F1 of the display surface member D faces to the front when the rotor R assumes such a rotational position (which will hereinafter be referred to as the first rotational position) where the north and south magnetic poles of the double-pole permanent magnet member M1 are opposite to trailing ends a of the magnetic poles P1 and P2 of the magnetic member B1 in the clockwise direction, respectively, and the north and south magnetic poles of the double-pole permanent magnet member M2 are opposite to leading ends b of the magnetic poles P3 and P4 of the magnetic member B2 in the clockwise direction, respectively.

Figure 6:
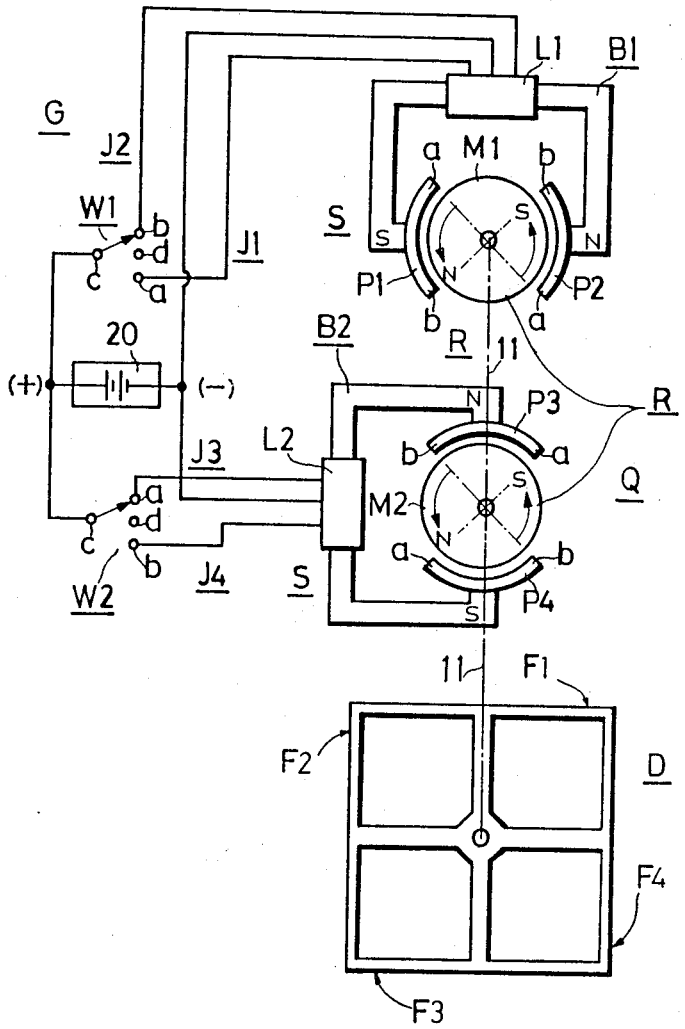
Figure 7:
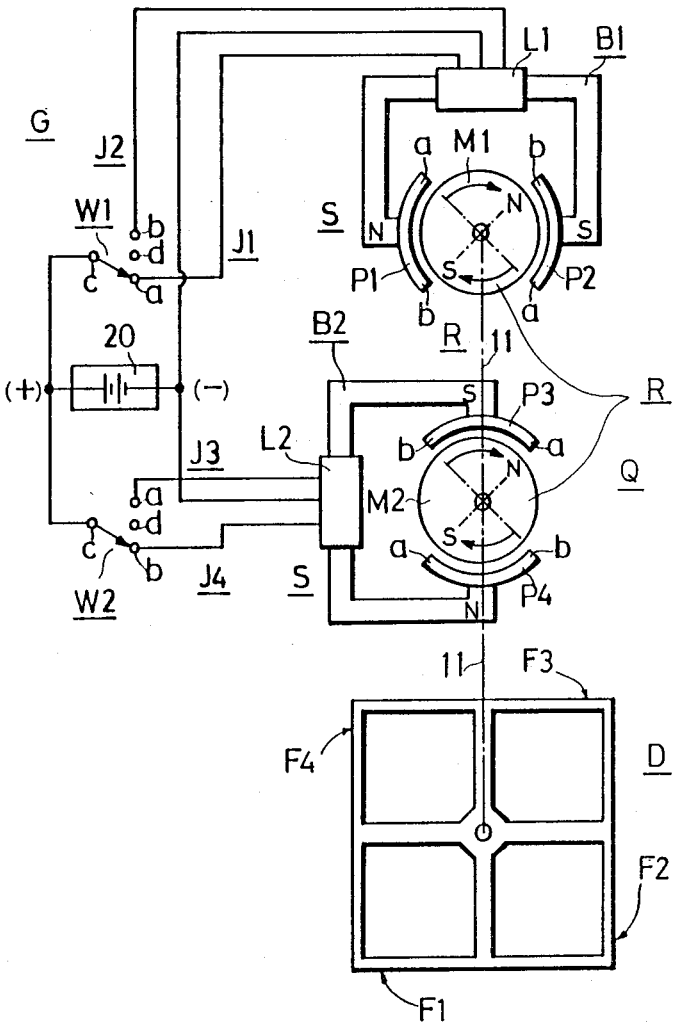
Figure 10:
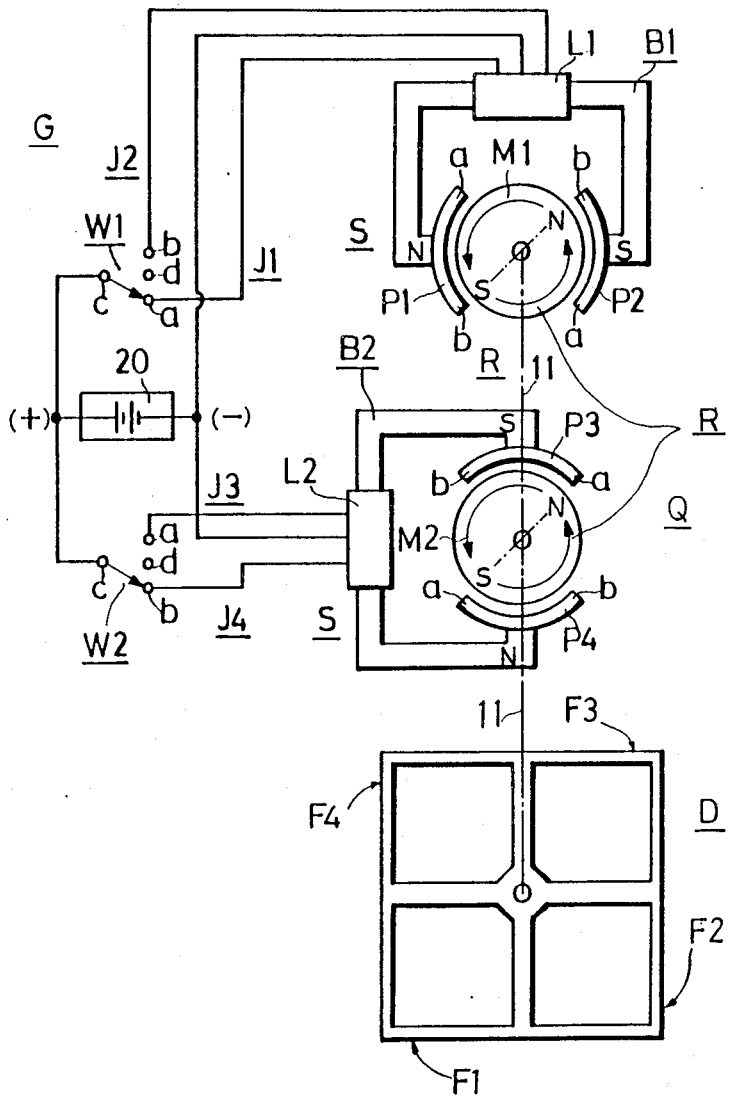
Figure 13:
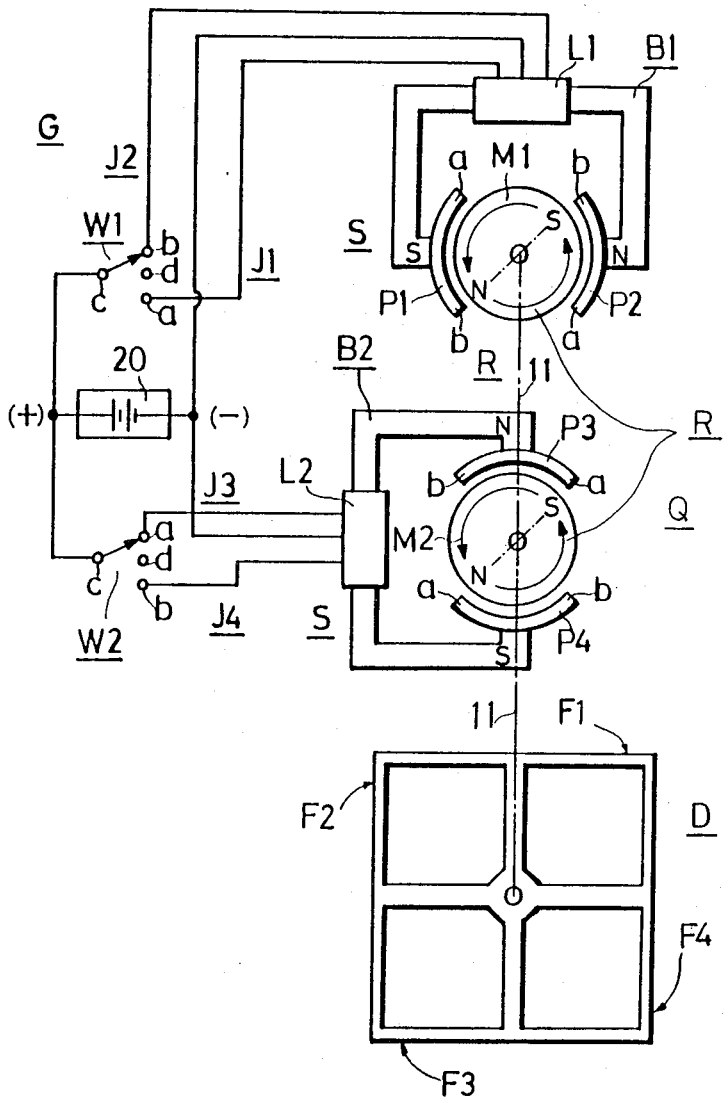
Figure 16:
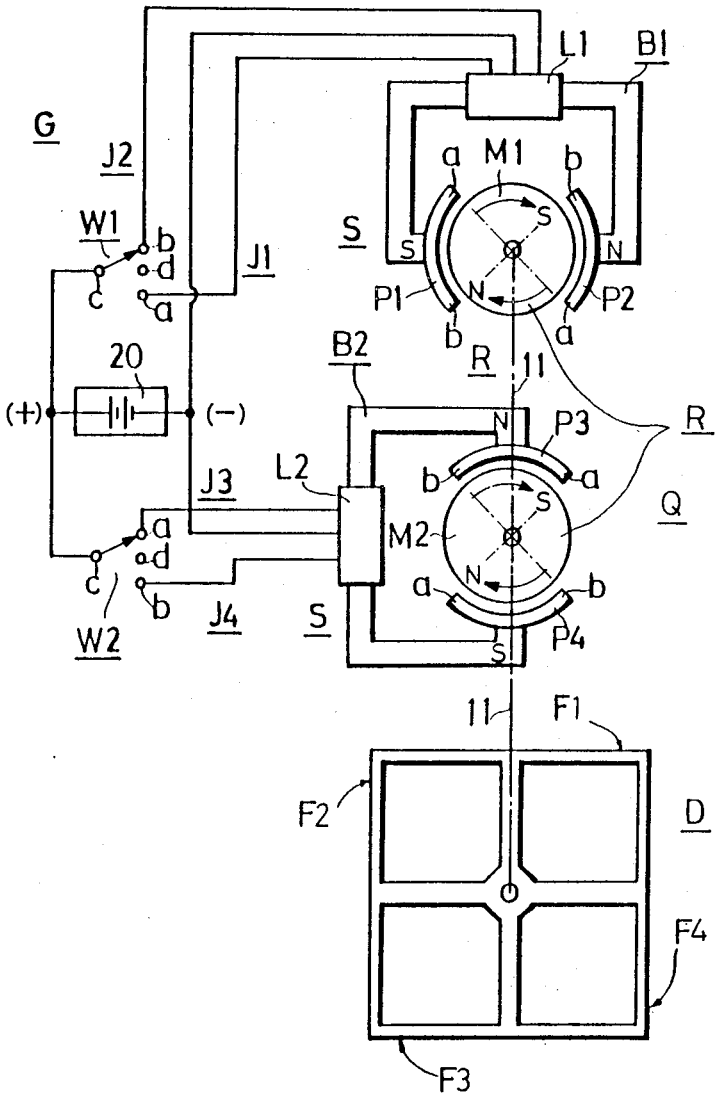
Figure 17:
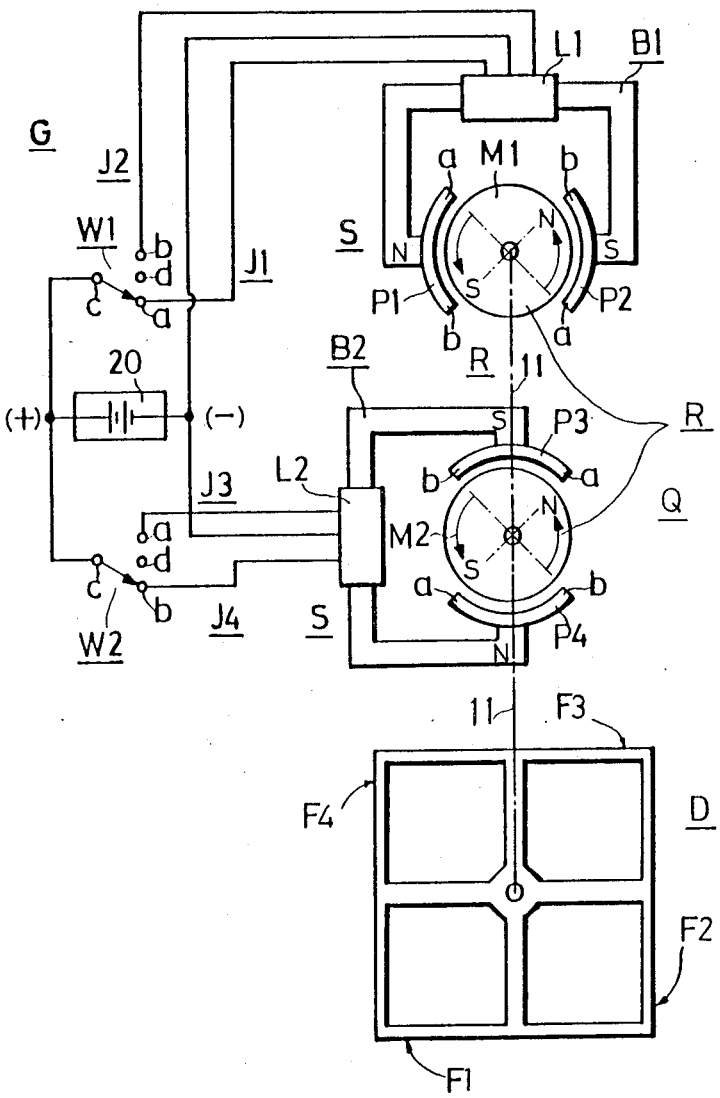

Further, the display surface member D is mounted on the rotor R in such a manner that, as shown in FIGS. 6, 13 and 16, the display surface F4 of the display surface member D faces to the front when the rotor R assumes such a rotational position (which will hereinafter be referred to as the fourth rotational position) where the north and south magnetic poles of the double-pole permanent magnet member M1 confront the leading ends b of the magnetic poles P1 and P2 of the magnetic member B1 in the clockwise direction, respectively, and the north and south magnetic poles of the double-pole permanent magnet member M2 confront the trailing ends a of the magnetic poles P4 and P3 of the magnetic member B2 in the clockwise direction, respectively. Moreover, the display surface member D is mounted on the rotor R in such a manner that, as shown in FIGS. 7, 10 and 17, the display surface F2 of the display surface member D faces to the front when the rotor R assumes such a rotational position (which will hereinafter be referred to as the second stational position) where the north and south magnetic poles of the double-pole permanent magnet member M1 are opposite to the leading ends b of the magnetic poles P2 and P1 of the magnetic member B1 in the clockwise direction, respectively, and the north and south magnetic poles of the double-pole permanent magnet member M2 are opposite to the trailing ends a of the magnetic poles P3 and P4 of the magnetic member B2 in the clockwise direction, respectively.

Figure 8:
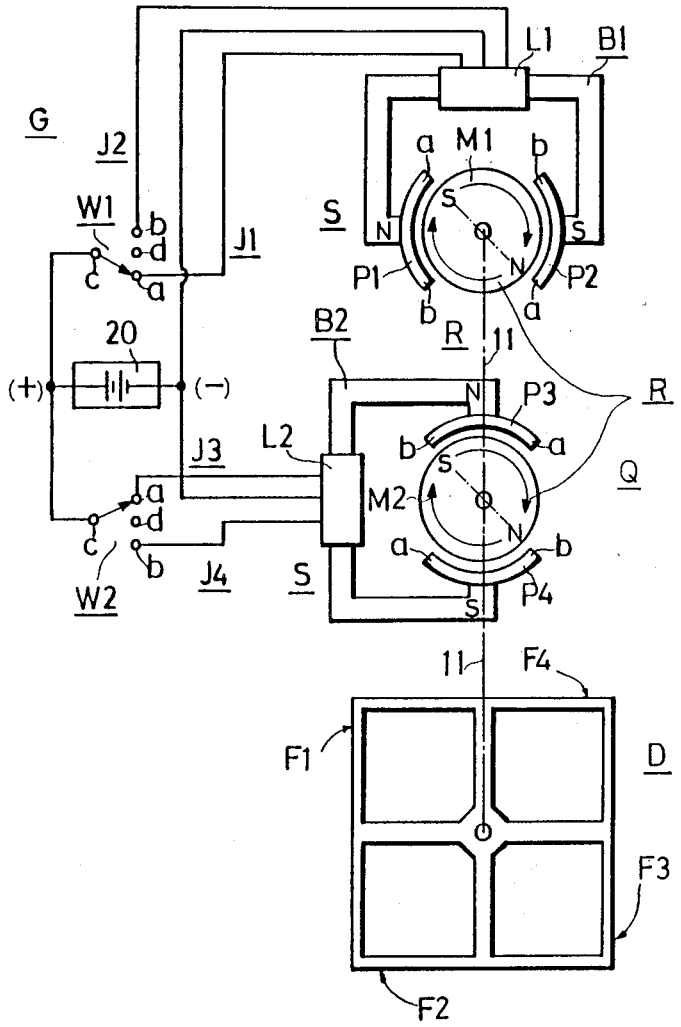
Figure 11:
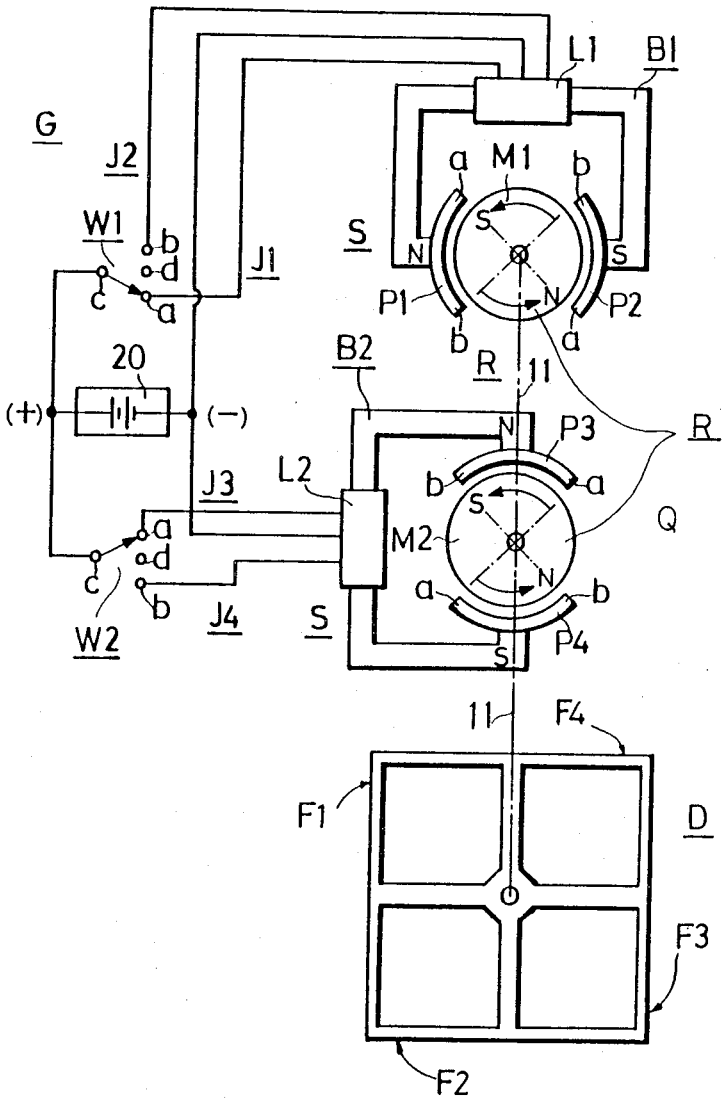
Figure 14:
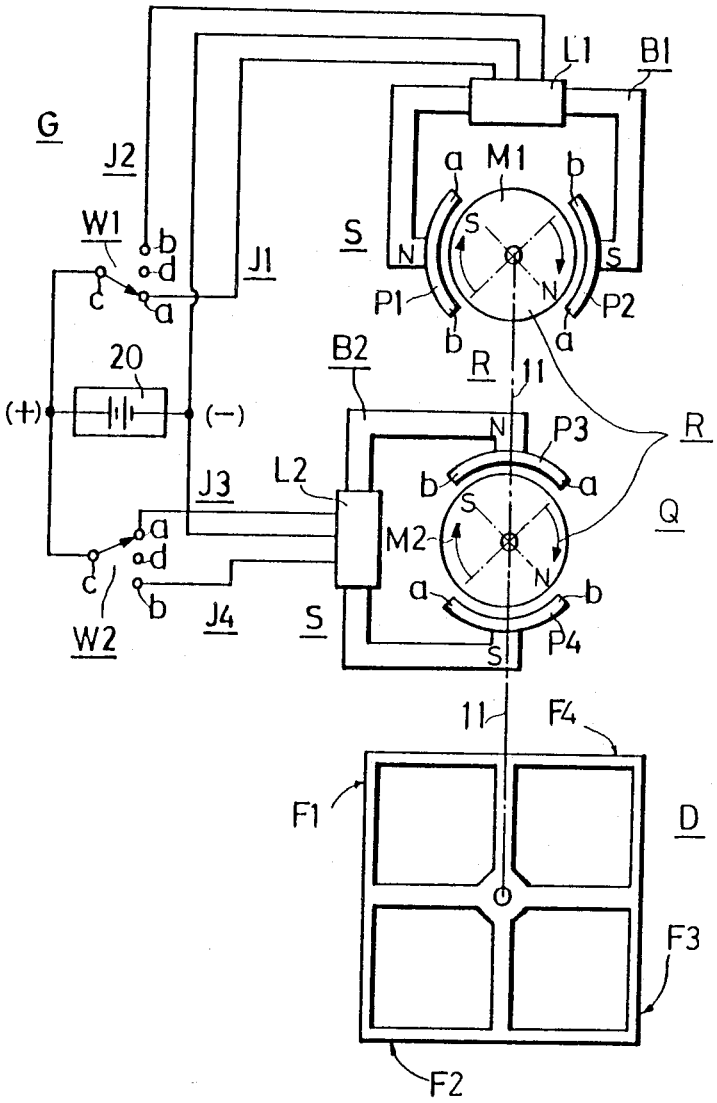

Furthermore, the display surface member D is mounted on the rotor R in such a manner that, as shown in FIGS. 8, 11 and 14, the display surface F3 of the display surface member D faces to the front when the rotor R assumes such a rotational position (which will hereinafter be referred to as the third rotational position) where the north and south magnetic poles of the double-pole permanent magnet member M1 confront the trailing ends a of the magnetic pole portions P2 and P1 of the magnetic member B1 in the clockwise direction, respectively, and the north and south magnetic poles of the double-pole permanent magnet member M2 confront the leading ends b of the magnetic poles P4 and P3 of the magnetic member B2 in the clockwise direction, respectively.

As illustrated in FIGS. 5 to 17, the driving device G is provided with power supply means J1 for supplying power to the exciting winding L1 which forms the stator S of the motor mechanism Q so that the magnetic poles P1 and P2 of the magnetic member B1 serve as north and south magnetic poles, respectively, power supply means J2 for supplying power to the exciting winding L1 so that the magnetic poles P1 and P2 of the magnetic member B1 serve as south and north magnetic poles, respectively, power supply means J3 for supplying power to the exciting winding L2 which forms the stator S of the motor mechanism Q so that the magnetic poles P3 and P4 of the magnetic member B2 act as north and south magnetic poles, respectively, and power supply means J4 for supplying power to the exciting winding L2 so that the magnetic poles P3 and P4 of the magnetic member B2 act as south and north magnetic poles, respectively.

An example of the power supply means J1 has such an arrangement that the positive side of a DC power source 20 is connected to one end of the exciting winding L1 via a movable contact c and a fixed contact a of a change-over switch W1 and the negative side of the DC power source 20 is connected directly to the mid point of the exciting winding L1.

An example of the power supply means J2 has such an arrangement that the positive side of the DC power source 20 is connected to the other end of the exciting winding L1 via the movable contact c and another fixed contact b of the change-over switch W1 and the negative side of the DC power source 20 is connected to the mid point of the exciting winding L1.

An example of the power supply means J3 has such an arrangement that the positive side of the DC power source 20 is connected to one end of the exciting winding L2 via a movable contact c and a fixed contact a of a change-over switch W2 and the negative side of the DC power source 20 is connected directly to the mid point of the exciting winding L2.

An example of the power supply means J4 has such an arrangement that the positive side of the DC power source 20 is connected to the other end of the exciting winding L2 via the movable contact c and another contact b of the change-over switch W2 and the negative side of the DC power source 20 is connected to the mid point of the exciting winding L2.

The foregoing has clarified the outline of the arrangement of an embodiment of the display unit employing the rotating display element according to the present invention. Next, a description will be given of details of the arrangement and its operation.

With the above-described arrangement of the display unit employing the rotating display element according to the present invention, the rotor R forming the motor mechanism Q has the two double-pole permanent magnet members M1 and M2 mounted on the rotary shaft 11, and the north and south magnetic poles of the double-pole permanent magnet member M1 and the north and south magnetic poles of the double-pole permanent magnet member M2 are spaced an angular distance of $\pm\alpha°$ (where $\alpha°=0°$ in the drawings) apart around the rotary shaft 11.

The foregoing has clarified the outline of the arrangement of an embodiment of the display unit employing the rotating display elements according to the present invention. Next, a description will be given of details of the arrangement and its operation.

With the above-described arrangement of the display unit employing the rotating display elements according to the present invention, the rotor R forming the motor mechanism Q has the two double-pole permanent magnet members M1 and M2 mounted on the rotary shaft 11, and the north and south magnetic poles of the double-pole permanent magnet member M1 and the north and south magnetic poles of the double-pole permanent magnet member M2 are spaced an angular distance of $\pm\alpha°$ (where $\alpha°=0°$ in the drawings) apart around the rotary shaft 11.

On the other hand, the stator S forming the motor mechanism Q has the magnetic member B1 which is provided with the magnetic poles P1 and P2 spaced a 180° angular distance apart around the rotary shaft 11, for acting on the north and south magnetic poles of the double-pole permanent magnet member M1, and the magnetic member B2 which has the magnetic poles P3 and P4 spaced an angular distance of $\pm 90° \pm \alpha°$ apart from the magnetic poles P1 and P2 of the double-pole permanent magnet member M1 and disposed at 90° intervals around the rotary shaft 11, for acting on the north and south magnetic poles of the double-pole permanent magnet member M2. The magnetic poles P1 and P2 of the magnetic member B1 extend around the rotary shaft 11 over an angular range of 90°, and the magnetic poles P3 and P4 of the magnetic member B2 similarly extend around the rotary shaft 11 over an angular range of 90°.

With such an arrangement, in the case where the movable contacts c of the aforesaid change-over switches W1 and W2 are connected to fixed contacts d other than the aforesaid ones a and b and, consequently, no power is supplied to either of the exciting windings L1 and L2 of the stator S, the rotor R of the motor mechanism Q assumes the aforementioned first rotational position where the north and south magnetic poles of the double-pole permanent magnet member M1 are opposite to the ends a of the magnetic poles P1 and P2 of the magnetic member B1, respectively, and the north and south magnetic poles of the double-pole permanent magnet member M2 are opposite to the ends b of the magnetic poles P3 and P4 of the magnetic member B2, respectively, as illustrated in FIGS. 5, 9, 12 and 15, the aforementioned fourth rotational position where the north and south magnetic poles of the double-pole permanent magnet member M1 are opposite to the ends b of the magnetic poles P1 and P2 of the magnetic member B1, respectively, and the north and south magnetic poles of the double-pole permanent magnet member M2 are opposite to the ends a of the magnetic poles P4 and P3 of the magnetic member B2 as shown in FIGS. 6, 13 and 16, the aforementioned second rotational position where the north and south magnetic poles of the double-pole permanent magnet member M1 are opposite the ends b of the magnetic poles P2 and P1 of the magnetic member B1, respectively, and the north and south magnetic poles of the double-pole permanent magnet member M2 are opposite to the ends a of the magnetic poles P3 and P4 of the magnetic member B2 as shown in FIGS. 7, 10 and 17, or the aforementioned third rotational position where the north and south magnetic poles of the double-pole permanent magnet member M1 are opposite to the ends a of the magnetic poles P2 and P1 of the magnetic member B1, respectively, and the north and south magnetic poles of the double-pole permanent magnet member M2 are opposite to the ends b of the magnetic poles P4 and P3 of the magnetic member B2 as illustrated in FIGS. 8, 11 and 14.

The reason is as follows:

That is, in a case where the rotor R is caused to rotate counterclockwise from its first rotational position shown in FIGS. 5, 9, 12 and 15, since the north and south magnetic poles of the double-pole permanent magnet member M1 do not move out of the opposing relation to the magnetic poles P1 and P2 of the magnetic member B1, there does not develop in the double-pole permanent magnet member M1 a rotating torque which prevents the rotor R from rotating counterclockwise, but since the north and south magnetic poles of the double-pole permanent magnet member M2 move out of the opposing relation to the magnetic poles P3 and P4 of the magnetic member B2, there develops in the double-pole permanent magnet member M2 a rotating torque which prevents the rotor R from rotating counterclockwise. Further, in a case where the rotor R is caused to rotate clockwise from its first rotational position shown in FIGS. 5, 9 and 16, since the north and south magnetic poles of the double-pole permanent magnet member M2 do not move out of the opposing relation to the magnetic poles P3 and P4 of the magnetic member B2, there does not develop in the double-pole permanent magnet member M2 a rotating torque which prevents the rotor R from rotating clockwise, but since the north and south magnetic poles of the double-pole permanent magnet member M1 move out of the opposing relation to the magnetic poles P1 and P2 of the magnetic member B1, there develops in the double-pole permanent magnet M1 a rotating torque which prevents the rotor R from rotating clockwise.

In a case where the rotor R is caused to rotate clockwise from its fourth rotational position shown in FIGS. 6, 13 and 16, since the north and south magnetic poles of the double-pole permanent magnet member M1 do not move out of the opposing relation to the magnetic poles P1 and P2 of the magnetic member B1, there does not develop in the double-pole permanent magnet member M1 a rotating torque which prevents the rotor R from rotating clockwise, but since the north and south magnetic poles of the double-pole permanent magnet member M2 move out of the opposing relation to the magnetic poles P4 and P3 of the magnetic member B2, there develops in the double-pole permanent magnet member M2 a rotating torque which prevents the rotor R from rotating clockwise. Further, in a case where the rotor R is caused to rotate counterclockwise from its fourth rotational position shown in FIGS. 6, 13 and 16, since the north and south magnetic poles of the double-pole permanent magnet member M2 do not move out of the opposing relation to the magnetic poles P4 and P3 of the magnetic member B2, there does not develop in the double-pole permanent magnet member M2 a rotating torque which prevents the rotor R from rotating counterclockwise, but since the north and south magnetic poles of the double-pole permanent magnet member M1 move out of the opposing relation to the magnetic poles P1 and P2 of the magnetic member B1, there develops in the double-pole permanent magnet member M1 a rotating torque which prevents the rotor R from rotating counterclockwise.

In a case where the rotor R is caused to rotate clockwise from its second rotational position shown in FIGS. 7, 10 and 17, since the north and south magnetic poles of the double-pole permanent magnet member M1 do not move out of the opposing relation to the magnetic poles P2 and P1 of the magnetic member B1, there does not develop in the double-pole permanent magnet member M1 a rotating torque which prevents the rotor R from rotating clockwise, but since the north and south magnetic poles of the double-pole permanent magnet member M2 move out of the opposing relation to the magnetic poles P3 and P4 of the magnetic member B2, there develops in the double-pole permanent magnet member M2 a rotating torque which prevents the rotor R from rotating clockwise. Further, in a case where the rotor R is caused to rotate counterclockwise from its second rotational position shown in FIGS. 7, 10 and 17, since the north and south magnetic poles of the double-pole permanent magnet member M2 do not move out of the opposing relation to the magnetic poles P3 and P4 of the magnetic member B2, there does not develop in the double-pole permanent magnet member M2 a rotating torque which prevents the rotor R from rotating counterclockwise, but since the north and south magnetic poles of the double-pole permanent magnet member M1 move out of the opposing relation to the magnetic poles P2 and P1 of the magnetic member B1, there develops in the double-pole permanent magnet M1 a rotating torque which prevents the rotor R from rotating counterclockwise.

In a case where the rotor R is caused to rotate counterclockwise from its third rotational position shown in FIGS. 8, 11 and 14, since the north and south magnetic poles of the double-pole permanent magnet member M1 do not move out of the opposing relation to the magnetic poles P2 and P1 of the magnetic member B1, there does not develop in the double-pole permanent magnet member M1 a rotating torque which prevents the rotor R from rotating counterclockwise, but since the north and south magnetic poles of the double-pole permanent magnet member M2 move out of the opposing relation to the magnetic poles P4 and P3 of the magnetic member B2, there develops in the double-pole permanent magnet member M2 a rotating torque which prevents the rotor R from rotating counterclockwise. Further, in a case where the rotor R is caused to rotate clockwise from its third rotational position shown in FIGS. 8, 11 and 14, since the north and south magnetic poles of the double-pole permanent magnet member M2 do not move out of the opposing relation to the magnetic poles P4 and P3 of the magnetic member B2, there does not develop in the double-pole permanent magnet member M2 a rotating torque which prevents the rotor R from rotating clockwise, but since the north and south magnetic poles of the double-pole permanent magnet member M1 move out of the opposing relation to the magnetic poles P2 and P1 of the magnetic member B1, there develops in the double-pole permanent magnet M1 a rotating torque which prevents the rotor R from rotating clockwise.

For the reasons given above, when no power is supplied to either of the exciting windings L1 and L2 of the stator S, the rotor R assume any one of the aforesaid first, second, third and fourth rotational positions.

Furthermore, as described previously, the display surface member D is mounted on the rotor R of the motor mechanism Q so that the display surfaces F1, F2, F3 and F4 respectively face to the front when the rotor R assumes the abovesaid first, second, third and fourth rotational positions.

Figure 5:
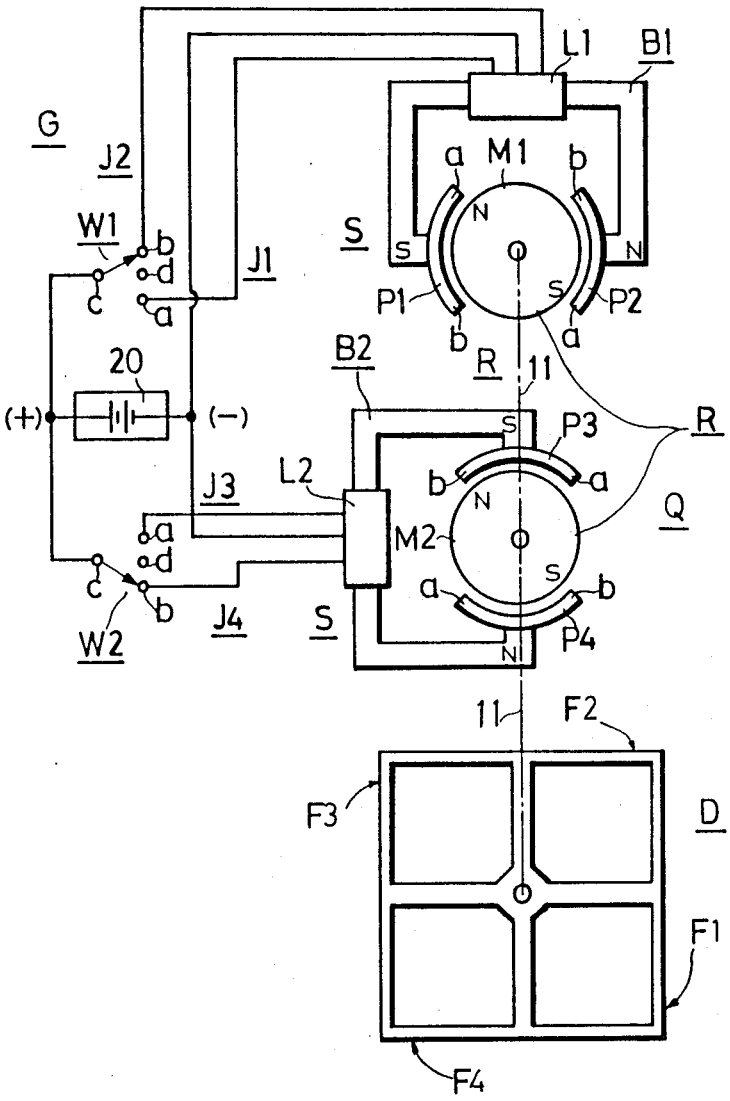
FIGS. 5 to 17 are schematic diagrams explanatory of the operation of the display unit of the present invention shown in FIG. 1.

Now, let it be assumed that the rotor R of the motor mechanism Q lies at the first rotational position and, consequently, the display element E is in such a state that the display surface F1 of the display surface member D faces to the front (This state will hereinafter be referred to as the first state). In such a first state of the display element E, even if power is supplied, for a very short time, via the power supply means J2 to the exciting winding L1 forming the stator S of the motor mechanism Q and power is supplied, for a very short time, to the exciting winding L2 via the power supply means J4 a little before or after the start of the abovesaid power supply, as shown in FIG. 5, the display element E is retained in the first state.

The reason is as follows:

By the power supply to the exciting winding L1 via the power supply means J2, the magnetic poles P1 and P2 of the magnetic member B1 become south and north magnetic poles, respectively, to produce a small counterclockwise rotating torque in the double-pole permanent magnet member M1, by which the rotor R tends to rotate counterclockwise. By the power supply to the exciting winding L2 via the power supply means J4, however, the magnetic poles P3 and P4 of the magnetic member B2 become south and north magnetic poles, respectively, to produce a small clockwise rotating torque in the double-pole permanent magnet member M2, by which the rotor R tends to rotate clockwise. Accordingly, there develops in the rotor R no rotating torque, or only a small counterclockwise or clockwise rotating torque. In a case where the small counterclockwise rotating torque is produced in the rotor R, the north and south magnetic poles of the double-pole permanent magnet member M1 remain in the opposing relation to the magnetic poles P1 and P2 of the magnetic member B1 now having become the south and north magnetic poles, respectively, so that there does not develop in the double-pole permanent magnet member M1 a rotating torque which prevents the rotor R from rotating counterclockwise. But, since the north and south magnetic poles of the double-pole permanent magnet member M2 move out of the opposing relation to the magnetic poles P3 and P4 of the magnetic member B2 now having become the south and north magnetic poles, respectively, there is produced in the double-pole permanent magnet member M2 a rotating torque which prevents counterclockwise rotational movement of the rotor R. Further, in a case where the abovesaid small clockwise rotating torque is produced in the rotor R, the north and south magnetic poles of the double-pole permanent magnet member M2 do not move out of the opposing relation to the magnetic poles P3 and P4 of the magnetic member B2 having become the south and north magnetic poles, respectively, so that there does not develop in the double-pole permanent magnet member M2 a rotating torque which prevents the rotor R from rotating clockwise, but since the north and south magnetic poles of the double-pole permanent magnet member M1 get out of the opposing relation to the magnetic poles P1 and P2 having become the south and north magnetic poles, respectively, there is produced in the double-pole permanent magnet member M1 a rotating torque which prevents the clockwise rotational movement of the rotor R.

For the reason given above, even if power is supplied to the exciting windings L1 and L2 via the power supply means J2 and J4 when the display element E is in the first state, the display element E remains in the first state.

When the display element E is in the first state, if power is supplied, for a very short time, via the power supply means J2 to the exciting winding L1 and power is supplied, for a very short time, to the exciting winding L2 via the power supply means J3 a little before or after the start of the abovesaid power supply, as shown in FIG. 6, the rotor R of the motor mechanism Q assumes the aforementioned fourth rotational position, by which the display element E is switched to the state in which to direct its display surface F4 to the front (which state will hereinafter be referred to as the fourth state) and is held in the fourth state.

The reason is as follows:

By the power supply to the exciting winding L1 via the power supply means J2, the magnetic poles P1 and P2 of the magnetic member B1 are magnetized with the south and north magnetic poles, respectively, but, in this case, since the north and south magnetic poles of the double-pole permanent magnet member M1 are opposite to the ends a of the magnetic poles P1 and P2, respectively, no rotating torque is produced in the double-pole permanent magnet member M1 or, even if produced, it is only a small counterclockwise rotating torque. By the power supply to the exciting winding L2 via the power supply means J3, however, the magnetic poles P3 and P4 of the magnetic member B2 are magnetized with the north and south magnetic poles, respectively, and, in this case, since the north and magnetic poles of the double-pole permanent magnet M2 lie opposite to the ends b of the magnetic poles P3 and P4, a large counterclockwise rotating torque is produced in the double-pole permanent magnet M2 owing to a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4. In consequence, a large counterclockwise rotating torque is produced in the rotor R, and the rotor R turns counterclockwise.

When the rotor R thus turns counterclockwise and the rotor R rotates counterclockwise in excess of 45° from the aforesaid first rotational position, since the north and south magnetic poles of the double-pole permanent magnet M1 move into opposing relation to the magnetic poles P1 and P2 of the magnetic member B1 now magnetized with the south and north magnetic poles, respectively, no rotating torque is produced in the double-pole permanent magnet M1, or even if generated, it is only a small clockwise rotating torque. But, since the north and south magnetic poles of the double-pole permanent magnet M2 approach the magnetic poles P4 and P3 now magnetized with the south and north magnetic poles, respectively, a large counterclockwise rotating torque is generated in the double-pole permanent magnet M2 by virtue of an attractive force between the north magnetic pole of the double-pole permanent magnet M2 and the south magnetic pole of the magnetic pole P4 and an attractive force between the south magnetic pole of the double-pole permanent magnet M2 and the north magnetic pole of the magnetic pole P3. As a result of this, the rotor R turns counterclockwise.

When the rotor R thus turns counterclockwise and the rotor R rotates counterclockwise in excess of 90° from the abovesaid first rotational position, since the north and south magnetic poles of the double-pole permanent magnet M2 turn into opposing relation to the magnetic poles P4 and P3 of the magnetic member B2 now magnetized with the south and north magnetic poles, respectively, no rotating torque is developed in the double-pole permanent magnet M2, or even if produced, it is only a small counterclockwise rotating torque. But, since the north and south magnetic poles of the double-pole permanent magnet M1 are out of opposing relation to the magnetic poles P1 and P2 now magnetized with the south and north magnetic poles, respectively, there is produced in the double-pole permanent magnet M1 a large rotating torque which prevents the rotor R from rotating counterclockwise in excess of 90° from the first state. Therefore, the rotor R does not turn counterclockwise in excess of 90° from the first rotational position.

For the reason given above, supplying power to the exciting windings L1 and L2 via the power supply means J2 and J3, respectively, when the display element E assumes the aforesaid first state, the display element E is switched to the fourth state and is held in the fourth state.

When the display element E is in the first state, if power is supplied, for a very short time, via the power supply means J1 to the exciting winding L1 and power is supplied, for a very short time, to the exciting winding L2 via the power supply means J4 a little before or after the start of the abovesaid power supply, as shown in FIG. 7, the rotor R of the motor mechanism Q assumes the aforementioned second rotational position, by which the display element E is switched to the state in which to direct its display surface F2 to the front (which state will hereinafter be referred to as the second state) and is held in the second state.

The reason is as follows:

By the power supply to the exciting winding L2 via the power supply means J4, the magnetic poles P3 and P4 of the magnetic member B2 are magnetized with the south and north magnetic poles, respectively, but, in this case, since the north and south magnetic poles of the double-pole permanent magnet member M2 are opposite to the ends b of the magnetic poles P3 and P4, respectively, no rotating torque is produced in the double-pole permanent magnet member M2 and, even if produced, it is only a small clockwise rotating torque. By the power supply to the exciting winding L1 via the power supply means J1, however, the magnetic poles P1 and P2 of the magnetic member B1 are magnetized with the north and south magnetic poles, respectively, and, in this case, since the north and magnetic poles of the double-pole permanent M1 lie opposite to the ends a of the magnetic poles P1 and P2, a large clockwise rotating torque is produced in the double-pole permanent magnet M1 owing to a repulsive force between the north magnetic pole of the double-pole permanent magnet M1 and the north magnetic pole of the magnetic pole P1 and a repulsive force between the south magnetic pole of the double-pole permanent magnet M1 and the south magnetic pole of the magnetic pole P2. In consequence, a large clockwise rotating torque is produced in the rotor R, and the rotor R turns clockwise.

When the rotor R thus turns clockwise and the rotor R rotates clockwise in excess of 45° from the aforesaid first rotational position, since the north and south magnetic poles of the double-pole permanent magnet M2 move into opposing relation to the magnetic poles P3 and P4 of the magnetic member B2 now magnetized with the south and north magnetic poles, respectively, no rotating torque is produced in the double-pole permanent magnet M2, or even if generated, it is only a small counterclockwise retating torque. But, since the north and south magnetic poles of the double-pole permanent magnet M1 approach the magnetic poles P2 and P1 now magnetized with the south and north magnetic poles, respectively, a large clockwise rotating torque is generated in the double-pole permanent magnet M1 by virtue of an attractive force between the north magnetic pole of the double-pole permanent magnet M1 and the south magnetic pole of the magnetic pole P2 and an attractive force between the south magnetic pole of the double-pole permanent magnet M1 and the north magnetic pole of the magnetic pole P1. As a result of this, the rotor R turns clockwise.

When the rotor R thus turns clockwise and the rotor R rotates clockwise in excess of 90° from the abovesaid first state, since the north and south magnetic poles of the double-pole permanent magnet M1 turn into opposing relation to the magnetic poles P2 and P1 of the magnetic member B1 now magnetized with the south and north magnetic poles, respectively, no rotating torque is developed in the double-pole permanent magnet M1, or even if produced, it is only a small clockwise rotating torque. But, since the north and south magnetic poles of the double-pole permanent magnet M2 are out of opposing relation to the magnetic poles P3 and P4 now magnetized with the south and north magnetic poles, respectively, there is produced in the double-pole permanent magnet M2 a large rotating torque which prevents the rotor R from rotating clockwise in excess of 90° from the first state. Therefore, the rotor R does not turn clockwise in excess of 90° from the first rotational position.

For the reason given above, supplying power to the exciting windings L1 and L2 via the power supply means J1 and J4, respectively, when the display element E assumes the aforesaid first state, the display element E is switched to the second state and is held in the second state.

When the display element E is in the first state, if power is supplied, for a very short time, via the power supply means J1 to the exciting winding L1 and power is supplied, for a very short time, to the exciting winding L2 via the power supply means J3 a little before or after the start of the abovesaid power supply, as shown in FIG. 8, the rotor R of the motor mechanism Q assumes the aforementioned third rotational position, by which the display element E is switched to the state in which to direct its display surface F3 to the front (which state will hereinafter be referred to as the third state) and is held in the third state.

The reason is as follows:

Let it be assumed that power is supplied to the exciting winding L1 via the power supply means J1 and then power is supplied to the exciting winding L2 via the power supply means J2 a little after the start of the abovesaid power supply. In such a case, by the power supply to the exciting winding L1 via the power supply means J1, the magnetic poles P1 and P2 of the magnetic member B1 are magnetized with the north and south magnetic poles, respectively, and, in this case, since the north and magnetic poles of the double-pole permanent magnet M1 lie opposite to the ends a of the magnetic poles P1 and P2, a large clockwise rotating torque is produced in the double-pole permanent magnet M1 owing to a repulsive force between the north magnetic pole of the double-pole permanent magnet M1 and the north magnetic pole of the magnetic pole P1 and a repulsive force between the south magnetic pole of the double-pole permanent magnet M1 and the south magnetic pole of the magnetic pole P2. In consequence, a clockwise rotating torque is produced in the rotor R, and the rotor R turns counterclockwise.

When the rotor R thus turns clockwise and the rotor R rotates clockwise in excess of 45° from the aforesaid first state, since the north and south magnetic poles of the double-pole permanent magnet M1 approach the magnetic poles P2 and P1 now magnetized with the south and north magnetic poles, respectively, a large clockwise rotating torque is generated in the double-pole permanent magnet M1 by virtue of an attractive force between the north magnetic pole of the double-pole permanent magnet M1 and the south magnetic pole of the magnetic pole P2 and an attractive force between the south magnetic pole of the double-pole permanent magnet M1 and the north magnetic pole of the magnetic pole P1.

Further, if the aforesaid power supply to the exciting winding L2 via the power supply means J3 is effected at or in the vicinity of the point of time when the rotor R has turned clockwise more than 45° from the aforementioned first rotational position, then the magnetic poles P3 and P4 of the magnetic member B2 are magnetized with the north and south magnetic poles, respectively, at that point of time and, in this case, since the north and south magnetic poles of the double-pole permanent magnet M2 lie in opposing relation to the magnetic poles P3 and P4, respectively, a clockwise rotating torque is generated in the double-pole permanent magnet M2 by virtue of a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4.

As a result of this, the rotor R turns clockwise.

When the rotor R thus turns clockwise and the rotor R rotates clockwise in excess of 90° from the abovesaid first state, since the north and south magnetic poles of the double-pole permanent magnet M1 turn into opposing relation to the ends b of the magnetic poles P2 and P1 of the magnetic member B1 now magnetized with the south and north magnetic poles, respectively, no rotating torque is developed in the double-pole permanent magnet M1, or even if produced, it is only a small clockwise rotating torque. But, since the north and south magnetic poles of the double-pole permanent magnet M2 are in opposing relation to the ends a of the magnetic poles P3 and P4 now magnetized with the north and south magnetic poles, respectively, there is produced in the double-pole permanent magnet M2 a large clockwise rotating torque owing to a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4. In consequence, a clockwise rotating torque is produced in the rotor R, and the rotor R turns clockwise.

When the rotor R thus turns clockwise and the rotor R rotates clockwise in excess of 135° from the aforesaid first rotational position, since the north and south magnetic poles of the double-pole permanent magnet M1 move into opposing relation to the magnetic poles P2 and P1 of the magnetic member B1 now magnetized with the south and north magnetic poles, respectively, no rotating torque is produced in the double-pole permanent magnet M1, or even if generated, it is only a small counterclockwise rotating torque. But, since the north and south magnetic poles of the double-pole permanent magnet M2 approach the magnetic poles P4 and P3 now magnetized with the south and north magnetic poles, respectively, a large clockwise rotating torque is generated in the double-pole permanent magnet M2 by virtue of an attractive force between the north magnetic pole of the double-pole permanent magnet M2 and the south magnetic pole of the magnetic pole P4 and an attractive force between the south magnetic pole of the double-pole permanent magnet M2 and the north magnetic pole of the magnetic pole P3. As a result of this, the rotor R turns clockwise.

When the rotor R thus turns clockwise and the rotor R rotates clockwise in excess of 180° from the abovesaid first rotational position, since the north and south magnetic poles of the double-pole permanent magnet M2 turn into opposing relation to the magnetic poles P4 and P3 of the magnetic member B2 now magnetized with the south and north magnetic poles, respectively, no rotating torque is developed in the double-pole permanent magnet M2, or even if produced, it is only a small clockwise rotating torque. But, since the north and south magnetic poles of the double-pole permanent magnet M1 are out of opposing relation to the magnetic poles P2 and P1 now magnetized with the south and north magnetic poles, respectively, however, there is produced in the double-pole permanent magnet M1 a large rotating torque which prevents the rotor R from rotating clockwise in excess of 180° from the first state. Therefore, the rotor R does not turn clockwise in excess of 180° from the first rotational position.

The above description has been given of the case where power is supplied first to the exciting winding L1 via the power supply means J1 and then power is supplied to the exciting winding L2 via the power supply means J3 a little after the above power supply but, on the contrary, in a case where power is supplied to the exciting winding L2 via the power supply means J3 and then power is supplied to the exciting winding L1 via the power supply means J1 after a little time, the rotor R turns by 180° from the first rotational position in the counterclockwise direction reverse from that in the above, though not described in detail.

For the reason given above, supplying power to the exciting windings L1 and L2 via the power supply means J1 and J3, respectively, when the display element E assumes the aforesaid first state, the display element E is switched to the third state and is held in the third state.

Now, let it be assumed that the rotor R of the motor mechanism lies at the fourth rotational position and, consequently, the display element E is in the fourth state that the display surface F4 of the display surface member D faces to the front. In such a fourth state of the display element E, even if power is supplied, for a very short time, via the power supply means J2 to the exciting winding L1 forming the stator S of the motor mechanism Q and power is supplied, for a very short time, to the exciting winding L2 via the power supply means J3 a little before or after the start of the abovesaid power supply, as shown in FIG. 6, the display element E remains in the fourth state.

The reason is as follows:

By the power supply to the exciting winding L1 via the power supply means J2, the magnetic poles P1 and P2 of the magnetic member B1 are magnetized with south and north magnetic poles, respectively, to produce a small clockwise rotating torque in the double-pole permanent magnet member M1, by which the rotor R tends to rotate clockwise. By the power supply to the exciting winding L2 via the power supply means J3, however, the magnetic poles P3 and P4 of the magnetic member B2 are magnetized with north and south magnetic poles, respectively, to produce a small counterclockwise rotating torque in the double-pole permanent magnet member M2, by which the rotor R tends to rotate counterclockwise. Accordingly, the develops in the rotor R no rotating torque, or only a small clockwise or counterclockwise rotating torque. In a case where the small clockwise rotating torque is produced in the rotor R, the north and south magnetic poles of the double-pole permanent magnet member M1 remain in the opposing relation to the magnetic poles P1 and P2 of the magnetic member B1 now having become the south and north magnetic poles, respectively, so that there does not develop in the double-pole permanent magnet member M1 a rotating torque which prevents the rotor R from rotating clockwise. But, since the north and south magnetic poles of the double-pole permanent magnet member M2 move out of the opposing relation to the magnetic poles P4 and P3 of the magnetic member B2 now having become the south and north magnetic poles, respectively, there is produced in the double-pole permanent magnet member M2 a rotating torque which prevents clockwise rotational movement of the rotor R. Further, in a case where the abovesaid small counterclockwise rotating torque is produced in the rotor R, the north and south magnetic poles of the double-pole permanent magnet member M2 do not move out of the opposing relation to the magnetic poles P4 and P3 having become the south and north magnetic poles, respectively, so that there does not develop in the double-pole permanent magnet member M2 a rotating torque which prevents the rotor R from rotating counterclockwise, but since the north and south magnetic poles of the double-pole permanent magnet member M1 get out of the opposing relation to the magnetic poles P1 and P2 having become the south and north magnetic poles, respectively, there is produced in the double-pole permanent magnet member M1 a rotating torque which prevents the counterclockwise rotational movement of the rotor R.

For the reason given above, even if power is supplied to the exciting windings L1 and L2 via the power supply means J2 and J3 when the display element E is in the fourth state, the display element E remains in the fourth state.

Figure 9:
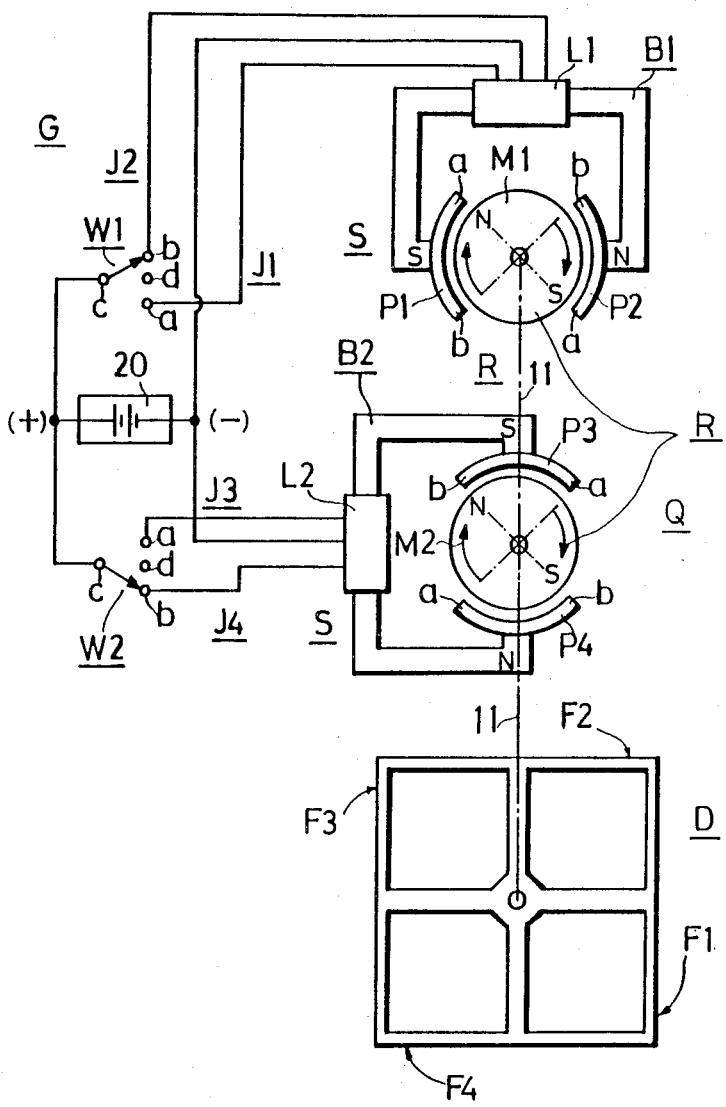

When the display element E is in the fourth state, if power is supplied, for a very short time, via the power supply means J2 to the exciting winding L1 and power is supplied, for a very short time, to the exciting winding L2 via the power supply means J4 a little before or after the start of the abovesaid power supply, as shown in FIG. 9, the rotor R of the motor mechanism Q assumes the aforementioned first rotational position, by which the display element E is switched to the first state in which to direct its display surface F1 to the front and is held in the first state.

The reason is as follows:

By the power supply to the exciting winding L1 via the power supply means J2, the magnetic poles P1 and P2 of the magnetic member B1 are magnetized with the south and north magnetic poles, respectively, but, in this case, since the north and south magnetic poles of the double-pole permanent magnet member M1 are opposite to the ends b of the magnetic poles P1 and P2, respectively, no rotating torque is produced in the double-pole permanent magnet member M1 and, even if produced, it is only a small clockwise rotating torque. By the power supply to the exciting winding L2 via the power supply means J4, however, the magnetic poles P3 and P4 of the magnetic member B2 are magnetized with the south and north magnetic poles, respectively, and, in this case, since the south and north magnetic poles of the double-pole permanent magnet M2 lie opposite to the ends a of the magnetic poles P3 and P4, a large clockwise rotating torque is produced in the double-pole permanent magnet M2 owing to a repulsive force between the north magnetic pole of the double-pole permanent magnet M2 and the north magnetic pole of the magnetic pole P4 and a repulsive force between the south magnetic pole of the double-pole permanent magnet M2 and the south magnetic pole of the magnetic pole P3. In consequence, a clockwise rotating torque is produced in the rotor R, and the rotor R turns clockwise.

When the rotor R thus turns clockwise and the rotor R rotates clockwise in excess of 45° from the aforesaid fourth state, since the north and south magnetic poles of the double-pole permanent magnet M1 move into opposing relation to the magnetic poles P1 and P2 of the magnetic member B1 now magnetized with the south and north magnetic poles, respectively, no rotating torque is produced in the double-pole permanent magnet M1, or even if generated, it is only a small counterclockwise rotating torque. But, since the north and south magnetic poles of the double-pole permanent magnet M2 approach the magnetic poles P3 and P4 now magnetized with the south and north magnetic poles, respectively, a large clockwise rotating torque is generated in the double-pole permanent magnet M2 by virtue of an attractive force between the north magnetic pole of the double-pole permanent magnet M2 and the south magnetic pole of the magnetic pole P3 and an attractive force between the south magnetic pole of the double-pole permanent magnet M2 and the north magnetic pole of the magnetic pole P4. As a result of this, the rotor R turns clockwise.

When the rotor R thus turns clockwise and the rotor R rotates clockwise in excess of 90° from the abovesaid fourth state, since the north and south magnetic poles of the double-pole permanent magnet M2 turn into opposing relation to the magnetic poles P3 and P4 of the magnetic member B2 now magnetized with the south and north magnetic poles, respectively, no rotating torque is developed in the double-pole permanent magnet M2, or even if produced, it is only a small clockwise rotating torque. But, since the north and south magnetic poles of the double-pole permanent magnet M1 are out of opposing relation to the magnetic poles P1 and P2 now magnetized with the south and north magnetic poles, respectively, however, there is produced in the double-pole permanent magnet M1 a large rotating torque which prevents the rotor R from rotating clockwise in excess of 90° from the fourth state. Therefore, the rotor R does not turn clockwise in excess of 90° from the fourth state.

For the reason given above, supplying power to the exciting windings L1 and L2 via the power supply means J2 and J4, respectively, when the display element E assumes the aforesaid fourth state, the display element E is switched to the first state and is held in the first state.

When the display element E is in the fourth state, if power is supplied, for a very short time, via the power supply means J1 to the exciting winding L1 and power is supplied, for a very short time, to the exciting winding L2 via the power supply means J4 a little before or after the start of the abovesaid power supply, as shown in FIG. 10, the rotor R of the motor mechanism Q assumes the aforementioned second rotational position, by which the display element E is switched to the second state in which to direct its display surface F2 to the front and is held in the second state.

The reason is as follows:

Let it be assumed that power is supplied to the exciting winding L1 via the power supply means J1 and then power is supplied to the exciting winding L2 via the power supply means J4 a little after the start of the abovesaid power supply.

In such a case, by the power supply to the exciting winding L1 via the power supply means J1, the magnetic poles P1 and P2 of the magnetic member B1 are magnetized with the north and south magnetic poles, respectively, and, in this case, since the north and south magnetic poles of the double-pole permanent magnet M1 lie opposite to the ends b of the magnetic poles P1 and P2, a large counterclockwise rotating torque is produced in the double-pole permanent magnet M1 owing to a repulsive force between the north magnetic pole of the double-pole permanent magnet M1 and the north magnetic pole of the magnetic pole P1 and a repulsive force between the south magnetic pole of the double-pole permanent magnet M1 and the south magnetic pole of the magnetic pole P2. In consequence, a counterclockwise rotating torque is produced in the rotor R, and the rotor R turns counterclockwise.

When the rotor R thus turns counterclockwise and the rotor R rotates counterclockwise in excess of 45° from the aforesaid fourth rotational position, since the north and south magnetic poles of the double-pole permanent magnet M1 aproach the magnetic poles P2 and P1 now magnetized with the south and north magnetic poles, respectively, a large counterclockwise rotating torque is generated in the double-pole permanent magnet M1 by virtue of an attractive force between the north magnetic pole of the double-pole permanent magnet M1 and the south magnetic pole of the magnetic pole P2 and an attractive force between the south magnetic pole of the double-pole permanent magnet M1 and the north magnetic pole of the magnetic pole P1.

Further, if the aforesaid power supply to the exciting winding L2 via the power supply means J4 is effected at or in the vicinity of the point of time when the rotor R has turned counterclockwise more than 45° from the aforementioned fourth rotational position, then the magnetic poles P4 and P3 of the magnetic member B2 are magnetized with the north and south magnetic poles, respectively, at that point of time and, in this case, since the north and south magnetic poles of the double-pole permanent magnet M2 lie in opposing relation to the magnetic poles P4 and P3, respectively, a counterclockwise rotating torque is generated in the double-pole permanent magnet M2 by virtue of a repulsive force between the north magnetic pole of the double-pole permanent magnet M2 and the north magnetic pole of the magnetic pole P4 and a repulsive force between the south magnetic pole of the double-pole permanent magnet M2 and the south magnetic pole of the magnetic pole P3.

As a result of this, the rotor R turns counterclockwise.

When the rotor R thus turns counterclockwise and the rotor R rotates clockwise in excess of 135° from the abovesaid fourth rotational position, since the north and south magnetic poles of the double-pole permanent magnet M1 move into opposing relation to the magnetic poles P2 and P1 of the magnetic member B1 now magnetized with the south and north magnetic poles, respectively, no rotating torque is developed in the double-pole permanent magnet M1, or even if produced, it is only a small clockwise rotating torque. But, since the north and south magnetic poles of the double-pole permanent magnet M2 approach the magnetic poles P3 and P4 now magnetized with the south and north magnetic poles, respectively, a large counterclockwise rotating torque is generated in the double-pole permanent magnet M2 by virtue of an attractive force between the north magnetic pole of the double-pole permanent magnet M2 and the south magnetic pole of the magnetic pole P3 and an attractive force between the south magnetic pole of the double-pole permanent magnet M2 and the north magnetic pole of the magnetic pole P4. As a result of this, the rotor R turns counterclockwise.

When the rotor R thus turns counterclockwise and the rotor R rotates counterclockwise in excess of 180° from the abovesaid fourth rotational position, since the north and south magnetic poles of the double-pole permanent magnet M2 turn into opposing relation to the magnetic poles P3 and P4 of the magnetic member B2 now magnetized with the south and north magnetic poles, respectively, no rotating torque is developed in the double-pole permanent magnet M2, or even if produced, it is only a small counterclockwise rotating torque. But, since the north and south magnetic poles of the double-pole permanent magnet M1 are out of opposing relation to the magnetic poles P2 and P1 now magnetized with the south and north magnetic poles, respectively, there is produced in the double-pole permanent magnet M1 a large rotating torque which prevents the rotor R from rotating counterclockwise in excess of 180° from the first state. Therefore, the rotor R does not turn counterclockwise in excess of 180° from the first rotational position.

The above description has been given of the case where power is supplied first to the exciting winding L1 via the power supply means J1 and then power is supplied to the exciting winding L2 via the power supply means J4 a little after the above power supply but, on the contrary, in a case where power is supplied to the exciting winding L2 via the power supply means J4 and then power is supplied to the exciting winding L1 via the power supply means J1 a little after the former power supply, the rotor R turns by 180° from the first rotational position in the clockwise direction reverse from that in the above, though not described in detail.

For the reason given above, supplying power to the exciting windings L1 and L2 via the power supply means J1 and J4, respectively, when the display element E assumes the aforesaid fourth state, the display element E is switched to the second state and is held in the second state.

When the display element E is in the fourth state, if power is supplied, for a very short time, via the power supply means J1 to the exciting winding L1 and power is supplied, for a very short time, to the exciting winding L2 via the power supply means J3 a little before or after the start of the former power supply, as shown in FIG. 11, the rotor R of the motor mechanism Q assumes the aforementioned third rotational position, by which the display element E is switched to the third state in which to direct its display surface F3 to the front and is held in the third state.

The reason is as follows:

By the power supply to the exciting winding L2 via the power supply means J3, the magnetic poles P3 and P4 of the magnetic member B2 are magnetized with the north and south magnetic poles, respectively, but, in this case, since the south and north magnetic poles of the double-pole permanent magnet member M2 are opposite to the ends a of the magnetic poles P3 and P4, respectively, no rotating torque is produced in the double-pole permanent magnet member M2 or, even if produced, it is only a small counterclockwise rotating torque. By the power supply to the exciting winding L1 via the power supply means J1, however, the magnetic poles P1 and P2 of the magnetic member B1 are magnetized with the north and south magnetic poles, respectively, and, in this case, since the north and magnetic poles of the double-pole permanent magnet M1 lie opposite to the ends b of the magnetic poles P1 and P2, a large counterclockwise rotating torque is produced in the double-pole permanent magnet M1 owing to a repulsive force between the north magnetic pole of the double-pole permanent magnet M1 and the north magnetic pole of the magnetic pole P1 and a repulsive force between the south magnetic pole of the double-pole permanent magnet M1 and the south magnetic pole of the magnetic pole P2. In consequence, a counterclockwise rotating torque is produced in the rotor R, and the rotor R turns counterclockwise.

When the rotor R thus turns counterclockwise and the rotor R rotates counterclockwise in excess of 45° from the aforesaid fourth rotational position, since the north and south magnetic poles of the double-pole permanent magnet M2 move into opposing relation to the magnetic poles P4 and P3 of the magnetic member B2 now magnetized with the south and north magnetic poles, respectively, no rotating torque is produced in the double-pole permanent magnet M2, or even if generated, it is only a small clockwise rotating torque. But, since the north and south magnetic poles of the double-pole permanent magnet M1 approach the magnetic poles P2 and P1 now magnetized with the south and north magnetic poles, respectively, a large counterclockwise rotating torque is generated in the double-pole permanent magnet M1 by virtue of an attractive force between the north magnetic pole of the double-pole permanent magnet M1 and the south magnetic pole of the magnetic pole P2 and an attractive force between the south magnetic pole of the double-pole permanent magnet M1 and the north magnetic pole of the magnetic pole P1. As a result of this, the rotor R turns counterclockwise.

When the rotor R thus turns counterclockwise and the rotor R rotates counterclockwise in excess of 90° from the abovesaid fourth rotational position, since the north and south magnetic poles of the double-pole permanent magnet M1 turn into opposing relation to the magnetic poles P2 and P1 of the magnetic member B1 now magnetized with the south and north magnetic poles, respectively, no rotating torque is developed in the double-pole permanent magnet M1, or even if produced, it is only a small counterclockwise rotating torque. But, since the north and south magnetic poles of the double-pole permanent magnet M2 are out of opposing relation to the magnetic poles P4 and P3 now magnetized with the south and north magnetic poles, respectively, there is produced in the double-pole permanent magnet M2 a large rotating torque which prevents the rotor R from rotating counterclockwise in excess of 90° from the fourth rotational position. Therefore, the rotor R does not turn counterclockwise in excess of 90° from the fourth rotational position.

For the reason given above, supplying power to the exciting windings L1 and L2 via the power supply means J1 and J3, respectively, when the display element E assumes the aforesaid fourth state, the display element E is switched to the third state and is held in the third state.

Now, let it be assumed that the rotor R of the motor mechanism lies at the second rotational position and, consequently, the display element E is in the second state that the display surface F2 of the display surface member D faces to the front. In such a second state of the display element E, even if power is supplied, for a very short time, via the power supply means J1 to the exciting winding L1 forming the stator S of the motor mechanism Q and power is supplied, for a very short time, to the exciting winding L2 via the power supply means J4 a little before or after the start of the former power supply, as shown in FIG. 7, the display element E remains in the second state.

The reason is as follows:

By the power supply to the exciting winding L1 via the power supply means J1, the magnetic poles P1 and P2 of the magnetic member B1 are magnetized with the north ans south magnetic poles, respectively, to produce a small clockwise rotating torque in the double-pole permanent magnet member M1, by which the rotor R tends to rotate clockwise. By the power supply to the exciting winding L2 via the power supply means J4, however, the magnetic poles P3 and P4 of the magnetic member B2 are magnetized with the south and north magnetic poles, respectively, to produce a small counterclockwise rotating torque in the double-pole permanent magnet member M2, by which the rotor R tends to rotate counterclockwise. Accordingly, there develops in the rotor R no rotating torque, or only a small counterclockwise or clockwise or clockwise rotating torque. In a case where the small clockwise rotating torque is produced in the rotor R, the south and north magnetic poles of the double-pole permanent magnet member M1 remain in the opposing relation to the magnetic poles P1 and P2 of the magnetic member B1 now having become the north and south magnetic poles, respectively, so that there does not develop in the double-pole permanent magnet member M1 a rotating torque which prevents the rotor R from rotating clockwise. But, since the north and south magnetic poles of the double-pole permanent magnet member M2 move out of the opposing relation to the magnetic poles P3 and P4 of the magnetic member B2 now having become the south and north magnetic poles, respectively, there is produced in the double-pole permanent magnet member M2 a rotating torque which prevents clockwise rotational movement of the rotor R. Further, in a case where the abovesaid small counterclockwise rotating torque is produced in the rotor R, the north and south magnetic poles of the double-pole permanent magnet member M2 do not move out of the opposing relation to the magnetic poles P3 and P4 having become the south and north magnetic poles, respectively, so that there does not develop in the double-pole permanent magnet member M2 a rotating torque which prevents the rotor R from rotating counterclockwise, but since the north and south magnetic poles of the double-pole permanent magnet member M1 get out of the opposing relation to the magnetic poles P2 and P1 having become the south and north magnetic poles, respectively, there is produced in the double-pole permanent magnet member M1 a rotating torque which prevents the counterclockwise rotational movement of the rotor R.

For the reason given above, even if power is supplied to the exciting windings L1 and L2 via the power supply means J1 and J4 when the display element E is in the second state, the display element E remain in the second state.

Figure 12:
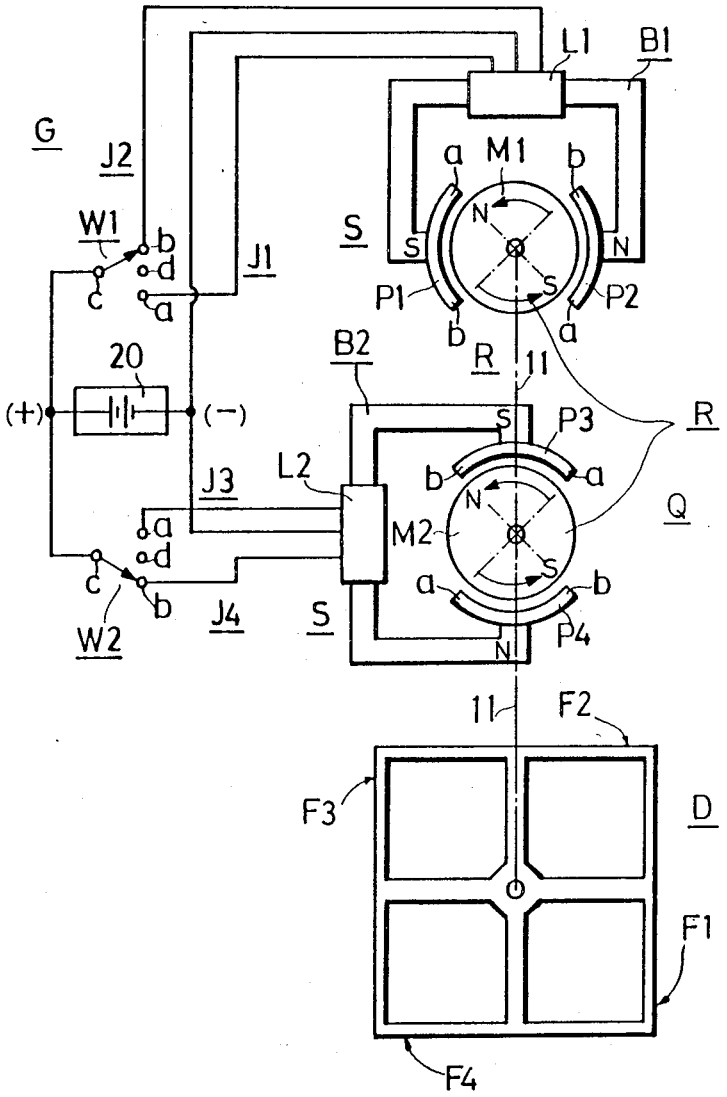

When the display element E is in the second state, if power is supplied, for a very short time, via the power supply means J2 to the exciting winding L1 and power is supplied, for a very short time, to the exciting winding L2 via the power supply means J4 a little before or after the start of the former power supply, as shown in FIG. 12, the rotor R of the motor mechanism Q assumes the aforementioned first rotational position, by which the display element E is switched to the first state in which to direct its display surface F1 to the front and is held in the first state.

The reason is as follows:

By the power supply to the exciting winding L2 via the power supply means J4, the magnetic poles P3 and P4 of the magnetic member B2 are magnetized with the south and north magnetic poles, respectively, but, in this case, since the north and south magnetic poles of the double-pole permanent magnet member M2 are opposite to the ends a of the magnetic poles P3 and P4, respectively, no rotating torque is produced in the double-pole permanent magnet member M2 or, even if produced, it is only a small counterclockwise rotating torque. By the power supply to the exciting winding L1 via the power supply means J2, however, the magnetic poles P1 and P2 of the magnetic member B1 are magnetized with the south and north magnetic poles, respectively, and, in this case, since the south and north magnetic poles of the double-pole permanent magnet M1 lie opposite to the ends b of the magnetic poles P1 and P2, a large counterclockwise rotating torque is produced in the double-pole permanent magnet M1 owing to a repulsive force between the north magnetic pole of the double-pole permanent magnet M1 and the north magnetic pole of the magnetic pole P2 and a repulsive force between the south magnetic pole of the double-pole permanent magnet M1 and the south magnetic pole of the magnetic pole P1. In consequence, a counterclockwise rotating torque is produced in the rotor R, and the rotor R turns counterclockwise.

When the rotor R thus turns counterclockwise and the rotor R rotates counterclockwise in excess of 45° from the aforesaid second rotational position, since the north and south magnetic poles of the double-pole permanent magnet M2 move into opposing relation to the magnetic poles P3 and P4 of the magnetic member B2 now magnetized with the south and north magnetic poles, respectively, no rotating torque is produced in the double-pole permanent magnet M2, or even if generated, it is only a small clockwise retating torque. But, since the north and south magnetic poles of the double-pole permanent magnet M1 approach the magnetic poles P1 and P2 now magnetized with the south and north magnetic poles, respectively, a large counterclockwise rotating torque is generated in the double-pole permanent magnet M1 by virtue of an attractive force between the north magnetic pole of the double-pole permanent magnet M1 and the south magnetic pole of the magnetic pole P1 and an attractive force between the south magnetic pole of the double-pole permanent magnet M1 and the north magnetic pole of the magnetic pole P2. As a result of this, the rotor R turns counterclockwise.

When the rotor R thus turns conterclockwise and the rotor R rotates counterclockwise in excess of 90° from the abovesaid second rotational position, since the north and south magnetic poles of the double-pole permanent magnet M1 turn into opposing relation to the magnetic poles P1 and P2 of the magnetic member B1 now magnetized with the south and north magnetic poles, respectively, no rotating torque is developed in the double-pole permanent magnet M1, or even if produced, it is only a small counterclockwise rotating torque. But, since the north and south magnetic poles of the double-pole permanent magnet M2 are out of opposing relation to the magnetic poles P3 and P4 now magnetized with the south and north magnetic poles, respectively, there is produced in the double-pole permanent magnet M2 a large rotating torque which prevents the rotor R from rotating counterclockwise in excess of 90° from the second rotational position. Therefore, the rotor R does not turn counterclockwise in excess of 90° from the second rotational position.

For the reason given above, supplying power to the exciting windings L1 and L2 via the power supply means J2 and J4, respectively, when the display element E assumes the aforesaid second state, the display element E is switched to the first state and is held in the first state.

When the display element E is in the second state, if power is supplied, for a very short time, via the power supply means J2 to the exciting winding L1 and power is supplied, for a very short time, to the exciting winding L2 via the power supply means J3 a little before or after the start of the former power supply, as shown in FIG. 13, the rotor R of the motor mechanism Q assumes the aforementioned fourth rotational position, by which the display element E is switched to the state in which to direct its display surface F4 to the front and is held in the fourth state.

The reason is as follows:

Let it be assumed that power is supplied to the exciting winding L1 via the power supply means J2 and then power is supplied to the exciting winding L2 via the power supply means J3 a little after the start of the former power supply.

In such a case, by the power supply to the exciting winding L1 via the power supply means J2, the magnetic poles P1 and P2 of the magnetic member B1 are magnetized with the south and north magnetic poles, respectively, and, in this case, since the south and north and magnetic poles of the double-pole permanent magnet M1 lie opposite to the ends b of the magnetic poles P1 and P2, a large counterclockwise rotating torque is produced in the double-pole permanent magnet M1 owing to a repulsive force between the north magnetic pole of the double-pole permanent magnet M1 and the north magnetic pole of the magnetic pole P2 and a repulsive force between the south magnetic pole of the double-pole permanent magnet M1 and the south magnetic pole of the magnetic pole P1. In consequence, a counterclockwise rotating torque is produced in the rotor R, and the rotor R turns counterclockwise.

When the rotor R thus turns counterclockwise and the rotor R rotates counterclockwise in excess of 45° from the aforesaid second state, since the north and south magnetic poles of the double-pole permanent magnet M1 approach the magnetic poles P1 and P2 now magnetized with the south and north magnetic poles, respectively, a large counterclockwise rotating torque is generated in the double-pole permanent magnet M1 by virtue of an attractive force between the north magnetic pole of the double-pole permanent magnet M1 and the south magnetic pole of the magnetic pole P1 and an attractive force between the south magnetic pole of the double-pole permanent magnet M1 and the north magnetic pole of the magnetic pole P2.

Further, if the aforesaid power supply to the exciting winding L2 via the power supply means J3 is effected at or in the vicinity of the point of time when the rotor R has turned counterclockwise more than 45 from the aforementioned second rotational position, then the magnetic poles P3 and P4 of the magnetic member B2 are magnetized with the north and magnetic poles, respectively, at that point of time and, in this case, since the north and south magnetic poles of the double-pole permanent magnet M2 lie in opposing relation to the magnetic poles P3 and P4, respectively, a large counterclockwise rotating torque is generated in the double-pole permanent magnet M2 by virtue of a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4.

As a result of this, the rotor R turns counterclockwise.

When the rotor R thus turns counterclockwise and the rotor R rotates counterclockwise in excess of 90° from the abovesaid second rotational position, since the north and south magnetic poles of the double-pole permanent magnet M1 turn into opposing relation to the ends a of the magnetic poles P1 and P2 of the magnetic member B1 now magnetized with the south and north magnetic poles, respectively, no rotating torque is developed in the double-pole permanent magnet M1, or even if produced, it is only a small counterclockwise rotating torque. But, since the north and south magnetic poles of the double-pole permanent magnet M2 are in opposing relation to the ends b of the magnetic poles P3 and P4 now magnetized with the north and south magnetic poles, respectively, there is produced in the double-pole permanent magnet M2 a large counterclockwise rotating torque owing to a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4. In consequence, a counterclockwise rotating torque is produced in the rotor R, and the rotor R turns counterclockwise.

When the rotor R thus turns counterclockwise and the rotor R rotates clockwise in excess of 135° from the aforesaid second rotational position, since the north and south magnetic poles of the double-pole permanent magnet M1 move into opposing relation to the magnetic poles P1 and P2 of the magnetic member B1 now magnetized with the south and north magnetic poles, respectively, no rotating torque is produced in the double-pole permanent magnet M1, or even if generated, it is only a small clockwise rotating torque. But, since the north and south magnetic poles of the double-pole permanent magnet M2 approach the magnetic poles P4 and P3 now magnetized with the south and north magnetic poles, respectively, a large counterclockwise rotating torque is generated in the double-pole permanent magnet M2 by virtue of an attractive force between the north magnetic pole of the double-pole permanent magnet M2 and the south magnetic pole of the magnetic pole P4 and an attractive force between the south magnetic pole of the double-pole permanent magnet M2 and the north magnetic pole of the magnetic pole P3. As a result of this, the rotor R turns counterclockwise When the rotor R thus turns counterclockwise and the rotor R rotates counterclockwise in excess of 180° from the abovesaid second rotational position, since the north and south magnetic poles of the double-pole permanent magnet M2 turn into opposing relation to the magnetic poles P4 and P3 of the magnetic member B2 now magnetized with the south and north magnetic poles, respectively, no rotating torque is developed in the double-pole permanent magnet M2, or even if produced, it is only a small counterclockwise rotating torque. But, since the north and south magnetic poles of the double-pole permanent magnet M1 are out of opposing relation to the magnetic poles P1 and P2 now magnetized with the south and north magnetic poles, respectively, there is produced in the double-pole permanent magnet M1 a large rotating torque which prevents the rotor R from rotating counterclockwise in excess of 180° from the second state. Therefore, the rotor R does not turn counterclockwise in excess of 180° from the second rotational position.

The above description has been given of the case where power is supplied first to the exciting winding L1 via the power supply means J2 and then power is supplied to the exciting winding L2 via the power supply means J3 a little after the former power supply but, on the contrary, in a case where power is supplied to the exciting winding L2 via the power supply means J3 and then power is supplied to the exciting winding L1 via the power supply means J2 a little time after the former power supply, the rotor R turns by 180° from the first rotational position in the clockwise direction reverse from that in the above, though not described in detail.

For the reason given above, supplying power to the exciting windings L1 and L2 via the power supply means J2 and J3, respectively, when the display element E assumes the aforesaid second state, the display element E is held in the fourth state.

When the display element E is in the second state, if power is supplied, for a very short time, via the power supply means J1 to the exciting winding L1 and power is supplied, for a very short time, to the exciting winding L2 via the power supply means J3 a little before or after the start of the former power supply, as shown in FIG. 14, the rotor R of the motor mechanism Q assumes the aforementioned third rotational position, by which the display element E is switched to the third state in which to direct its display surface F3 to the front and is held in the third state.

The reason is as follows:

By the power supply to the exciting winding L1 via the power supply means J1, the magnetic poles P1 and P2 of the magnetic member B1 are magnetized with the north and south magnetic poles, respectively, but, in this case, since the south and north magnetic poles of the double-pole permanent magnet member M1 are opposite to the ends b of the magnetic poles P1 and P2, respectively, no rotating torque is produced in the double-pole permanent magnet member M1 and, even if produced, it is only a small clockwise rotating torque. By the power supply to the exciting winding L2 via the power supply means J3, however, the magnetic poles P3 and P4 of the magnetic member B2 are magnetized with the north and south magnetic poles, respectively, and, in this case, since the north and magnetic poles of the double-pole permanent magnet M2 lie opposite to the ends a of the magnetic poles P3 and P4, a large clockwise rotating torque is produced in the double-pole permanent magnet M2 owing to a repulsive force between the north magnetic pole of the double-pole permanent magnet M2 and the north magnetic pole of the magnetic pole P3 and a repulsive force between the south magnetic pole of the double-pole permanent magnet M2 and the south magnetic pole of the magnetic pole P4. In consequence, a clockwise rotating torque is produced in the rotor R, and the rotor R turns clockwise.

When the rotor R thus turns clockwise and the rotor R rotates clockwise in excess of 45° from the aforesaid second rotational position, since the north and south magnetic poles of the double-pole permanent magnet M1 move into opposing relation to the magnetic poles P2 and P1 of the magnetic member B1 now magnetized with the south and north magnetic poles, respectively, no rotating torque is produced in the double-pole permanent magnet M1, or even if generated, it is only a small counterclockwise retating torque. But, since the north and south magnetic poles of the double-pole permanent magnet M2 approach the magnetic poles P4 and P3 now magnetized with the south and north magnetic poles, respectively, a large clockwise rotating torque is generated in the double-pole permanent magnet M2 by virtue of an attractive force between the north magnetic pole of the double-pole permanent magnet M2 and the south magnetic pole of the magnetic pole P4 and an attractive force between the south magnetic pole of the double-pole permanent magnet M2 and the north magnetic pole of the magnetic pole P3. As a result of this, the rotor R turns clockwise.

When the rotor R thus turns clockwise and the rotor R rotates clockwise in excess of 90° from the abovesaid second rotational position, since the north and south magnetic poles of the double-pole permanent magnet M2 turn into opposing relation to the magnetic poles P4 and P3 of the magnetic member B2 now magnetized with the south and north magnetic poles, respectively, no rotating torque is developed in the double-pole permanent magnet M2, or even if produced, it is only a small clockwise rotating torque. But, since the north and south magnetic poles of the double-pole permanent magnet M1 are out of opposing relation to the magnetic poles P2 and P1 now magnetized with the south and north magnetic poles, respectively, there is produced in the double-pole permanent magnet M1 a large rotating torque which prevents the rotor R from rotating clockwise in excess of 90° from the second state. Therefore, the rotor R does not turn clockwise in excess of 90° from the second rotational position.

For the reason given above, supplying power to the exciting windings L1 and L2 via the power supply means J1 and J3, respectively, when the display element E assumes the aforesaid second state, the display element E is switched to the third state and is held in the third state.

Now, let it be assumed that the rotor R of the motor mechanism lies at the third rotational position and, consequently, the display element E is in the third state that the display surface F3 of the display surface member D faces to the front. In such a third state of the display element E, even if power is supplied, for a very short time, via the power supply means J1 to the exciting winding L1 forming the stator S of the motor mechanism Q and power is supplied, for a very short time, to the exciting winding L2 via the power supply means J3 a little before or after the start of the former power supply, as shown in FIG. 8, the display element E remains in the third state.

The reason is as follows:

By the power supply to the exciting winding L1 via the power supply means J1, the magnetic poles P1 and P2 of the magnetic member B1 are magnetized with the north and south magnetic poles, respectively, to produce a small counterclockwise rotating torque in the double-pole permanent magnet member M1, by which the rotor R tends to rotate counterclockwise By the power supply to the exciting winding L2 via the power supply means J3, however, the magnetic poles P3 and P4 of the magnetic member B2 are magnetized with the north and south magnetic poles, respectively, to produce a small clockwise rotating torque in the double-pole permanent magnet member M2, by which the rotor R tends to rotate clockwise. Accordingly, there develops in the rotor R no rotating torque, or only a small counterclockwise or clockwise rotating torque. In a case where the small clockwise rotating torque is produced in the rotor R, the north and south magnetic poles of the double-pole permanent magnet member M2 remain in the opposing relation to the magnetic poles P4 and P3 of the magnetic member B2 now having become the south and north magnetic poles, respectively, so that there does not develop in the double-pole permanent magnet member M2 a rotating torque which prevents the rotor R from rotating clockwise. But, since the north and south magnetic poles of the double-pole permanent magnet member M1 move out of the opposing relation to the magnetic poles P2 and P1 of the magnetic member B1 now having become the south and north magnetic poles, respectively, there is produced in the double-pole permanent magnet member M1 a rotating torque which prevents clockwise rotational movement of the rotor R. Further, in a case where the abovesaid small counterclockwise rotating torque is produced in the rotor R, the north and south magnetic poles of the double-pole permanent magnet member M1 do not move out of the opposing relation to the magnetic poles P2 and P1 having become the south and north magnetic poles, respectively, so that there does not develop in the double-pole permanent magnet member M1 a rotating torque which prevents the rotor R from rotating counterclockwise, but since the north and south magnetic poles of the double-pole permanent magnet member M2 get out of the opposing relation to the magnetic poles P4 and P3 of the magnetic member B2 having become the south and north magnetic poles, respectively, there is produced in the double-pole permanent magnet member M2 a rotating torque which prevents the counterclockwise rotational movement of the rotor R.

For the reason given above, even if power is supplied to the exciting windings L1 and L2 via the power supply means J1 and J3 when the display element E is in the third state, the display element E remains in the third state.

Figure 15:
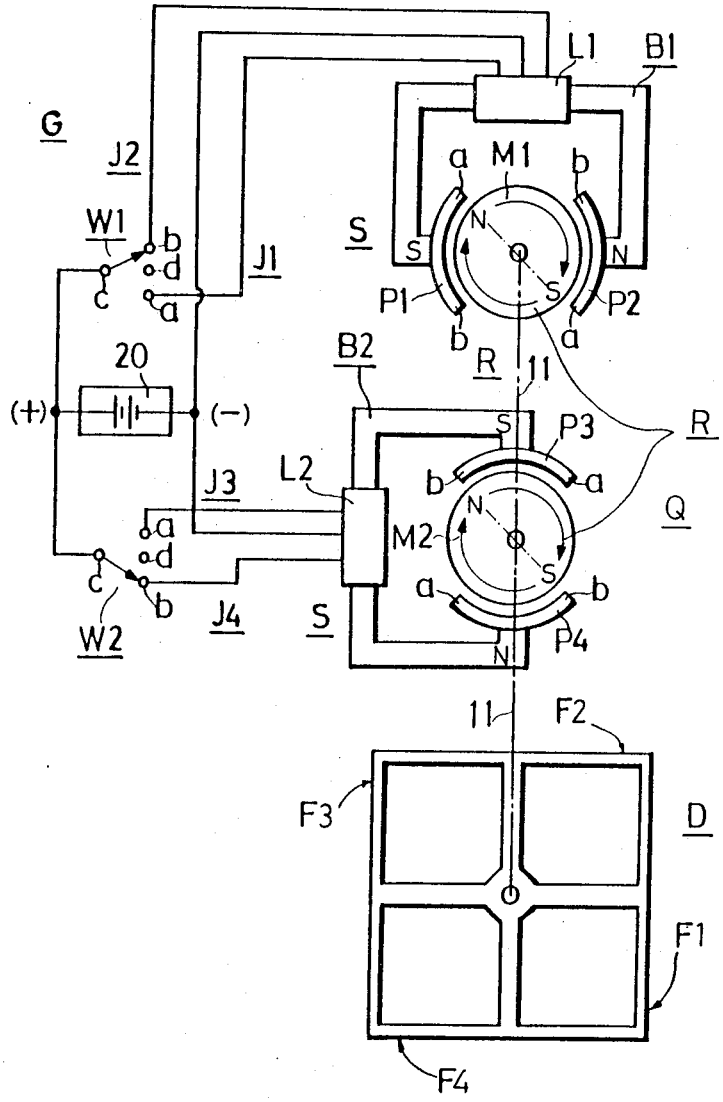

When the display element E is in the third state, if power is supplied, for a very short time, via the power supply means J2 to the exciting winding L1 and power is supplied, for a very short time, to the exciting winding L2 via the power supply means J4 a little before or after the start of the former power supply, as shown in FIG. 15, the rotor R of the motor mechanism Q assumes the aforementioned first rotational position, by which the display element E is switched to the state in which to direct its display surface F1 to the front and is held in the first state.

The reason is as follows:

Let it be assumed that power is supplied to the exciting winding L1 via the power supply means J2 and then power is supplied to the exciting winding L2 via the power supply means J4 a little after the start of the former power supply.

In such a case, by the power supply to the exciting winding L1 via the power supply means J2, the magnetic poles P1 and P2 of the magnetic member B1 are magnetized with the south and north magnetic poles, respectively, and, in this case, since the south and north magnetic poles of the double-pole permanent magnet M1 lie opposite to the ends a of the magnetic poles P1 and P2, a large clockwise rotating torque is produced in the double-pole permanent magnet M1 owing to a repulsive force between the north magnetic pole of the double-pole permanent magnet M1 and the north magnetic pole of the magnetic pole P2 and a repulsive force between the south magnetic pole of the double-pole permanent magnet M1 and the south magnetic pole of the magnetic pole P1. In consequence, a clockwise rotating torque is produced in the rotor R, and the rotor R turns clockwise.

When the rotor R thus turns clockwise and the rotor R rotates clockwise in excess of 45° from the aforesaid third rotational position, since the north and south magnetic poles of the double-pole permanent magnet M1 approach the magnetic poles P1 and P2 now magnetized with the south and north magnetic poles, respectively, a large clockwise rotating torque is generated in the double-pole permanent magnet M1 by virtue of an attractive force between the north magnetic pole of the double-pole permanent magnet M1 and the south magnetic pole of the magnetic pole P1 and an attractive force between the south magnetic pole of the double-pole permanent magnet M1 and the north magnetic pole of the magnetic pole P2.

Further, if the aforesaid power supply to the exciting winding L2 via the power supply means J4 is effected at or in the vicinity of the point of time when the rotor R has turned clockwise more than 45° from the aforementioned third rotational position, then the magnetic poles P3 and P4 of the magnetic member B2 are magnetized with the south and north magnetic poles, respectively, at that point of time and, in this case, since the south and north magnetic poles of the double-pole permanent magnet M2 lie in opposing relation to the magnetic poles P3 and P4, respectively, a clockwise rotating torque is generated in the double-pole permanent magnet M2 by virtue of a repulsive force between the north magnetic pole of the double-pole permanent magnet M2 and the north magnetic pole of the magnetic pole P4 and a repulsive force between the south magnetic pole of the double-pole permanent magnet M2 and the south magnetic pole of the magnetic pole P3.

As a result of this, the rotor R turns clockwise.

When the rotor R thus turns clockwise and the rotor R rotates clockwise in excess of 90° from the abovesaid third rotational position, since the north and south magnetic poles of the double-pole permanent magnet M1 turn into opposing relation to the ends b of the magnetic poles P1 and P2 of the magnetic member B1 now magnetized with the south and north magnetic poles, respectively, no rotating torque is developed in the double-pole permanent magnet M1, or even if produced, it is only a small clockwise rotating torque. But, since the north and south magnetic poles of the double-pole permanent magnet M2 are in opposing relation to the ends a of the magnetic poles P4 and P3 now magnetized with the north and south magnetic poles, respectively, there is produced in the double-pole permanent magnet M2 a large clockwise rotating torque owing to a repulsive force between the north magnetic pole of the double-pole permanent magnet M2 and the north magnetic pole of the magnetic pole P4 and a repulsive force between the south magnetic pole of the double-pole permanent magnet M2 and the south magnetic pole of the magnetic pole P3. In consequence, a clockwise rotating torque is produced in the rotor R, and the rotor R turns clockwise.

When the rotor R thus turns clockwise and the rotor R rotates clockwise in excess of 135° from the aforesaid third rotational position, since the north and south magnetic poles of the double-pole permanent magnet M1 move into opposing relation to the magnetic poles P1 and P2 of the magnetic member B1 now magnetized with the south and north magnetic poles, respectively, no rotating torque is produced in the double-pole permanent magnet M1, or even if generated, it is only a small counterclockwise rotating torque. But, since the north and south magnetic poles of the double-pole permanent magnet M2 approach the magnetic poles P3 and P4 now magnetized with the south and north magnetic poles, respectively, a large clockwise rotating torque is generated in the double-pole permanent magnet M2 by virtue of an attractive force between the north magnetic pole of the double-pole permanent magnet M2 and the south magnetic pole of the magnetic pole P3 and an attractive force between the south magnetic pole of the double-pole permanent magnet M2 and the north magnetic pole of the magnetic pole P4. As a result of this, the rotor R turns clockwise.

When the rotor R thus turns clockwise and the rotor R rotates clockwise in excess of 180° from the abovesaid third rotational position, since the north and south magnetic poles of the double-pole permanent magnet M2 turn into opposing relation to the magnetic poles P3 and P4 of the magnetic member B2 now magnetized with the south and north magnetic poles, respectively, no rotating torque is developed in the double-pole permanent magnet M2, or even if produced, it is only a small clockwise rotating torque. But, since the north and south magnetic poles of the double-pole permanent magnet M1 are out of opposing relation to the magnetic poles P1 and P2 now magnetized with the south and north magnetic poles, respectively, there is produced in the double-pole permanent magnet M1 a large rotating torque which prevents the rotor R from rotating clockwise in excess of 180° from the third rotational position. Therefore, the rotor R does not turn clockwise in excess of 180° from the third state.

The above description has been given of the case where power is supplied first to the exciting winding L1 via the power supply means J2 and then power is supplied to the exciting winding L2 via the power supply means J4 a little after the former power supply but, on the contrary, in a case where power is supplied to the exciting winding L2 via the power supply means J4 and then power is supplied to the exciting winding L1 via the power supply means J2 a little after the former power supply, the rotor R turns by 180° from the third rotational position in the counterclockwise direction reverse from that in the above, though not described in detail.

For the reason given above, supplying power to the exciting windings L1 and L2 via the power supply means J2 and J4, respectively, when the display element E assumes the aforesaid third state, the display element E is held in the first state.

When the display element E is in the third state, if power is supplied, for a very short time, via the power supply means J2 to the exciting winding L1 and power is supplied, for a very short time, to the exciting winding L2 via the power supply means J3 a little before or after the start of the former power supply, as shown in FIG. 16, the rotor R of the motor mechanism Q assumes the aforementioned fourth rotational position, by which the display element E is switched to the fourth state in which to direct its display surface F4 to the front and is held in the forth state.

The reason is as follows:

By the power supply to the exciting winding L2 via the power supply means J3, the magnetic poles P3 and P4 of the magnetic member B2 are magnetized with the north and south magnetic poles, respectively, but, in this case, since the south and north magnetic poles of the double-pole permanent magnet member M2 are opposite to the ends b of the magnetic poles P3 and P4, respectively, no rotating torque is produced in the double-pole permanent magnet member M2 or, even if produced, it is only a small clockwise rotating torque. By the power supply to the exciting winding L1 via the power supply means J2, however, the magnetic poles P1 and P2 of the magnetic member B1 are magnetized with the south and north magnetic poles, respectively, and, in this case, since the south and north magnetic poles of the double-pole permanent magnet M1 lie opposite to the ends a of the magnetic poles P1 and P2, a large clockwise rotating torque is produced in the double-pole permanent magnet M1 owing to a repulsive force between the north magnetic pole of the double-pole permanent magnet M1 and the north magnetic pole of the magnetic pole P2 and a repulsive force between the south magnetic pole of the double-pole permanent magnet M2 and the south magnetic pole of the magnetic pole P1. In consequence, a clockwise rotating torque is produced in the rotor R, and the rotor R turns clockwise.

When the rotor R thus turns clockwise and the rotor R rotates clockwise in excess of 45° from the aforesaid third rotational position, since the north and south magnetic poles of the double-pole permanent magnet M2 move into opposing relation to the magnetic poles P4 and P3 of the magnetic member B2 now magnetized with the south and north magnetic poles, respectively, no rotating torque is produced in the double-pole permanent magnet M2, or even if generated, it is only a small counterclockwise retating torque. But, since the north and south magnetic poles of the double-pole permanent magnet M1 approach the magnetic poles P1 and P2 now magnetized with the south and north magnetic poles, respectively, a large clockwise rotating torque is generated in the double-pole permanent magnet M1 by virtue of an attractive force between the north magnetic pole of the double-pole permanent magnet M1 and the south magnetic pole of the magnetic pole P1 and an attractive force between the south magnetic pole of the double-pole permanent magnet M1 and the north magnetic pole of the magnetic pole P2. As a result of this, the rotor R turns clockwise.

When the rotor R thus turns clockwise and the rotor R rotates clockwise in excess of 90° from the abovesaid third rotational position, since the north and south magnetic poles of the double-pole permanent magnet M1 turn into opposing relation to the magnetic poles P1 and P2 of the magnetic member B1 now magnetized with the south and north magnetic poles, respectively, no rotating torque is developed in the double-pole permanent magnet M1, or even if produced, it is only a small clockwise rotating torque. But, since the north and south magnetic poles of the double-pole permanent magnet M2 are out of opposing relation to the magnetic poles P4 and P3 now magnetized with the south and north magnetic poles, respectively, there is produced in the double-pole permanent magnet M2 a large rotating torque which prevents the rotor R from rotating clockwise in excess of 90° from the third rotational position. Therefore, the rotor R does not turn clockwise in excess of 90° from the third rotational position.

For the reason given above, supplying power to the exciting windings L1 and L2 via the power supply means J2 and J3, respectively, when the display element E assumes the aforesaid third state, the display element E is switched to the fourth state and is held in the fourth state.

When the display element E is in the third state, if power is supplied, for a very short time, via the power supply means J1 to the exciting winding L1 and power is supplied, for a very short time, to the exciting winding L2 via the power supply means J4 a little before or after the start of the former power supply, as shown in FIG. 17, the rotor R of the motor mechanism Q assumes the aforementioned second rotational position, by which the display element E is switched to the second state in which to direct its display surface F2 to the front and is held in the second state.

The reason is as follows:

By the power supply to the exciting winding L1 via the power supply means J1, the magnetic poles P1 and P2 of the magnetic member B1 are magnetized with the north and south magnetic poles, respectively, but, in this case, since the south and north magnetic poles of the double-pole permanent magnet member M1 are opposite to the ends a of the magnetic poles P1 and P2, respectively, no rotating torque is produced in the double-pole permanent magnet member M1, or even if produced, it is only a small counterclockwise rotating torque. By the power supply to the exciting winding L2 via the power supply means J4, however, the magnetic poles P3 and P4 of the magnetic member B2 are magnetized with the south and north magnetic poles, respectively, and, in this case, since the south and north magnetic poles of the double-pole permanent magnet M2 lie opposite to the ends b of the magnetic poles P3 and P4, a large counterclockwise rotating torque is produced in the double-pole permanent magnet M2 owing to a repulsive force between the north magnetic pole of the double-pole permanent magnet M2 and the north magnetic pole of the magnetic pole P4 and a repulsive force between the south magnetic pole of the double-pole permanent magnet M2 and the south magnetic pole of the magnetic pole P3. In consequence, a counterclockwise rotating torque is produced in the rotor R, and the rotor R turns counterclockwise.

When the rotor R thus turns counterclockwise and the rotor R rotates counterclockwise in excess of 45° from the aforesaid third rotational position, since the north and south magnetic poles of the double-pole permanent magnet M1 move into opposing relation to the magnetic poles P2 and P1 of the magnetic member B1 now magnetized with the south and north magnetic poles, respectively, no rotating torque is produced in the double-pole permanent magnet M1, or even if generated, it is only a small clockwise rotating torque. But, since the north and south magnetic poles of the double-pole permanent magnet M2 approach the magnetic poles P3 and P4 now magnetized with the south and north magnetic poles, respectively, a large counterclockwise rotating torque is generated in the double-pole permanent magnet M2 by virtue of an attractive force between the north magnetic pole of the double-pole permanent magnet M2 and the south magnetic pole of the magnetic pole P3 and an attractive force between the south magnetic pole of the double-pole permanent magnet M2 and the north magnetic pole of the magnetic pole P4. As a result of this, the rotor R turns clockwise.

When the rotor R thus turns counterclockwise and the rotor R rotates clockwise in excess of 90° from the abovesaid third rotational position, since the north and south magnetic poles of the double-pole permanent magnet M2 turn into opposing relation to the magnetic poles P3 and P4 of the magnetic member B2 now magnetized with the south and north magnetic poles, respectively, no rotating torque is developed in the double-pole permanent magnet M2, or even if produced, it is only a small counterclockwise rotating torque. But, since the north and south magnetic poles of the double-pole permanent magnet M1 are out of opposing relation to the magnetic poles P2 and P1 now magnetized with the south and north magnetic poles, respectively, there is produced in the double-pole permanent magnet M1 a large rotating torque which prevents the rotor R from rotating counterclockwise in excess of 90° from the third rotational position. Therefore, the rotor R does not turn counterclockwise in excess of 90° from the third rotational position.

For the reason given above, supplying power to the exciting windings L1 and L2 via the power supply means J1 and J4, respectively, when the display element E assumes the aforesaid third state, the display element E is switched to the second state and is held in the second state.

The foregoing description has clarifeid the arrangement of an example of the display unit employing the rotating display elements of the present invention.

As will be appreciated from the foregoing description, according to the present invention, the display surfaces F1, F4, F2 and F3 of the display surface member D constituting the display element E can selectively be directed to the front by simply selecting operations of:

(i) Supplying power, via the power supply means J2 forming the drive device G, to the exciting winding L1 of the stator S of the motor mechanism Q forming the display element E, and supplying power, from a point of time a little before or after the above power supply, to the exciting winding L2 of the stator S of the motor mechanism Q via the power supply means J4 forming the drive device G;

(ii) Supplying power to the exciting winding L1 via the power supply means J2, and supplying power, from a point of time a little before or after the above power supply, to the exciting winding L2 via the power supply means J3 forming the drive device G;

(iii) Supplying power to the exciting winding L1 via the power supply means J1, and supplying power, from a point of time a little before or after the above power supply, to the exciting winding L2 via the power supply means J4; and (iv) Supplying power to the exciting winding L1 via the power supply means J1, and supplying power, from a point of time a little before or after the above power supply, to the exciting winding L2 via the power supply means J3.

In the case where the display surfaces F1, F2, F3 and F4 of the display surface member D are selected to face to the front, even if the power supply to the exciting windings L1 and L2 of the stator S of the motor mechanism Q is OFF, the north and south magnetic poles of the double-pole permanent magnet members M1 and M2 of the rotor R constituting the motor mechanism Q act on the magnetic poles P1 and P2 of the magnetic member B1 of the stator S forming the motor mechanism Q and the magnetic poles P3 and P4 of the magnetic member B2 of the stator S, so that the display surfaces F1, F2, F3 and F4 of the display surface member D are selectively directed to the front, in position without the necessity of providing any particular means therefor. Further, no power consumption is involved therfor.

Since the display element E has incorporated, in the display surface member D, the motor mechanism Q for turning the display surface member D, a drive mechanism for turning the display surface member D need not be provided sepatately of the display element E.

The means for selecting the display surfaces F1, F2, F3 and F4 of the display surface member D of the display element E is very simple because it is formed by the power supply means J1 and J2 for the exciting winding L1 of the stator S forming the motor mechanism Q and the power supply means J3 and J4 for the exciting winding L2 of the stator S.

The foregoing description has been given of only one example of the display unit employing the rotating display elements of the present invention, and various modifications and variations may be effected.

For example, it is also possible that the double-pole permanent magnet members M1 and M2 of the rotor R making up the motor mechanism Q are formed as if constituted by such a single double-pole permanent magnet member that its portions divided into two in its axial direction serve as the double-pole permanent magnet members M1 and M2 although no detailed description will be given (In this case, aforementioned $\alpha°$ is 0°). With such an arrangement, too, the same operational effects as those described previously can be obtained, though not described in detail.

In the foregoing, it has been described, with respect to the magnetic members B1 and B2, that the angular ranges of the magnetic poles P1 and P2 of the magnetic member B1 and the magnetic poles P3 and P4 of the magnetic member B2, around the shaft 11 of the rotor R, are substantially 90° but, in connection with the double-pole permanent magnet members M1 and M2, no particular reference has been made to effective angular ranges of their north and south magnetic poles around the shaft 11 of the rotor R, as viewed from the free end faces of their north and south magnetic poles. The effective angular ranges may preferably be relatively narrow ones less than 45°, but they may take any values so long as they are smaller than 45°. Moreover, it is also possible that the effective angular ranges of the north and south magnetic poles of the double-pole permanent magnet members M1 and M2 around the shaft 11 of the rotor R as viewed from the free end faces of their north and south magnetic poles is selected approximately 90° and the angular ranges of the magnetic poles P1 and P2 of the magnetic member B1 and the magnetic poles P3 and P4 of the magnetic member B2 around the shaft 11 of the rotor R is selected less than 45° or so correspondingly. This also produces the same operational effects as those described previously.

While the foregoing description has been given of the case where the rotor R is a so-called inner rotor type, it will be seen that the rotor can be formed as an outer rotor type.

Various other modifications and variations may be effected without departing from the scope of the spirits of the present invention.

POSSIBILITY OF INDUSTRIAL USE

By producing a panel which has many display elements arranged in a matrix form on a common flat or curved surface, through using a number of display units of the present invention, a plurality of display surfaces of the many display elements can selectively be directed to the front, so that it is possible to display letters, symbols, graphic forms, patterns and so forth on the panel. Accordingly, the present invention can be applied, for example, to an advertizing panel, a traffic sign and the like.

I claim:

1. A rotating display element, characterized by the provision of a display surface member having a plurality of display surfaces, and a permanent magnet type motor mechanism;

wherein the display surface member is mounted on the rotor of the permanent magnet type motor mechanism so that it incorporates therein the permanent magnet type motor mechanism;

wherein the plurality of display surfaces of the display surface member are arranged side by side around the axis of the rotor;

wherein either one of the rotor and stator of the permanet magnet type motor mechanism has first and second double-pole permanent magnet members respectively having north and south magnetic poles and disposed side by side in the direction of extension of the axis of the rotor;

wherein the north and south magnetic poles of the first double-pole permanent magnet member are disposed around the axis of the rotor at an angular distance of 180° from each other;

wherein the north and south magnetic poles of the second double-pole permanent magnet member are disposed around the axis of the rotor at an angular distance of $\pm\alpha°$ (where $\alpha°$ has a value represented by $0° \leqq \alpha° < 180°$) from the north and south magnetic poles of the first double-pole permanent magnet member and at an angular distance of 180° from each other;

wherein the other of the rotor and the stator of the permanent magnet type motor has a first magnetic member provided with first and second magnetic poles acting on the north and south magnetic poles of the first double-pole permanent magnet member, a second magnetic member provided with third and fourth magnetic poles acting on the north and south magnetic poles of the second double-pole permanent magnet member, a first exciting winding wound on the first magnetic member in manner to excite the first and second magnetic poles in reverse polarities, and a second exciting winding wound on the second magnetic member in a manner to excite the third and fourth magnetic poles in reverse polarities;

wherein the first and second magnetic poles of the first magnetic member are disposed around the axis of the rotor at an angular distance of 180°; and wherein the third and fourth magnetic poles of the second magnetic member are disposed around the axis of the rotor at an angular distance of $\pm 90° \pm \alpha°$ from the first and second magnetic poles of the first magnetic member and at an angular distance of 180° from each other.

2. A rotating display element as claimed in claim 1, characterized in that the first and second magnetic poles of the first magnetic member and the third and fourth magnetic poles of the second magnetic member each extend around the axis of the rotor over an angular distance of about 90°.

3. A rotating display element as claimed in claim 1, characterized in that the number of the plurality of display surface of the display surface member is four.

4. A display unit, characterized by the provision of a rotating display element and a drive unit for driving the rotating display element;

wherein the rotating display element is provided with a display surface member having a plurality of display surfaces, and a permanent magnet type motor mechanism;

wherein the display surface member is mounted on the rotor of the permanent magnet type motor mechanism so that it incorporates therein the permanent magnet type motor mechanism;

wherein the plurality of display surfaces of the display surface member are arranged side by side around the axis of the rotor;

wherein either one of the rotor or the stator of the permanet magnet type motor mechanism has first and second double-pole permanent magnet members respectively having north and south magnetic poles and disposed side by side in the direction of extension of the axis of the rotor;

wherein the north and south magnetic poles of the first double-pole permanent magnet member are disposed around the axis of the rotor at an angular distance of 180° from each other;

wherein the north and south magnetic poles of the second double-pole permanent magnet member are disposed around the axis of the rotor at an angular distance of $\pm\alpha°$ (where $\alpha°$ has a value represented by $0° \leqq \alpha° < 180°$) from the north and south magnetic poles of the first double-pole permanent magnet member and at an angular distance of 180° from each other;

wherein the other of the rotor and the stator of the permanent magnet type motor mechanism has a first magnetic member provided with first and second magnetic poles acting on the north and south magnetic poles of the first double-pole permanent magnet member, a second magnetic member provided with third and fourth magnetic poles acting on the north and south magnetic poles of the second double-pole permanent magnet member, a first exciting winding wound on the first magnetic member in manner to excite the first and second magnetic poles in reverse polarities, and a second exciting winding wound on the second magnetic member in a manner to excite the third and fourth magnetic poles in reverse polarities;

wherein the first and second magnetic poles of the first magnetic member are disposed around the axis of the rotor at an angular distance of 180°;

wherein the third and fourth magnetic poles of the second magnetic member are disposed around the axis of the rotor at an angular distance of $\pm 90° \pm \alpha°$ from the first and second magnetic poles of the first magnetic member and at an angular distance of 180° from each other; and wherein the drive unit has first power supply means for supplying power to the first winding so that the first and second magnetic poles of the first magnetic member are magnetized with the north and south magnetic poles, respectively; second power supply means for supplying power to the first exciting winding so that the first and second magnetic poles of the first magnetic member are magnetized with the south and north magnetic poles, respectively; third power supply means for supplying power to the second exciting winding so that the third and fourth magnetic poles of the second magnetic member are magnetized with the north and south magnetic poles, respectively; and fourth power supply means for supplying power to the second exciting winding so that the third and fourth magnetic poles of the second magnetic member are magnetized with the south and north magnetic poles, respectively.

* * * * *